US011653764B2

(12) United States Patent
St-Fleur

(10) Patent No.: US 11,653,764 B2
(45) Date of Patent: May 23, 2023

(54) FOLDABLE MULTIFUNCTION CHAIR

(71) Applicant: Herardony St-Fleur, Montreal (CA)

(72) Inventor: Herardony St-Fleur, Montreal (CA)

(73) Assignee: Herardony St-Fleur, Montreal (CA)

( * ) Notice: Subject to any disclaimer, the term of this patent is extended or adjusted under 35 U.S.C. 154(b) by 182 days.

(21) Appl. No.: 16/860,219

(22) Filed: Apr. 28, 2020

(65) Prior Publication Data

US 2020/0345143 A1 Nov. 5, 2020

Related U.S. Application Data

(60) Provisional application No. 62/840,790, filed on Apr. 30, 2019.

(51) Int. Cl.
*A47C 1/024* (2006.01)
*A47C 1/028* (2006.01)
(Continued)

(52) U.S. Cl.
CPC ..... *A47C 1/0242* (2013.01); *A47C 1/02* (2013.01); *A47C 1/025* (2013.01); *A47C 1/028* (2013.01); *A47C 1/029* (2013.01); *A47C 1/031* (2013.01); *A47C 1/034* (2013.01); *A47C 1/035* (2013.01); *A47C 1/03211* (2013.01); *A47C 1/14* (2013.01);
(Continued)

(58) Field of Classification Search
CPC ..... A47C 1/0242; A47C 1/02; A47C 1/025; A47C 1/028; A47C 1/029; A47C 1/031; A47C 1/03211; A47C 1/034; A47C 1/035; A47C 1/14; A47C 1/143; A47C 3/16; A47C 4/28; A47C 7/50; A47C 7/506; A47C 1/026; A47C 1/0308; A47C 7/0213; A47C 7/38; A47C 7/543; A47C 4/08; A47C 4/18; A47C 7/705
USPC ..... 5/705; 297/1, 3, 173, 283.1, 354.12, 297/362.11, 362.13, 362.14, 283.2, 900
See application file for complete search history.

(56) References Cited

U.S. PATENT DOCUMENTS 564,044 A * 7/1896 Berkemeyer ..... A47C 7/70 297/170
818,917 A * 4/1906 Ruger ..... A47C 7/705 297/173
(Continued)

FOREIGN PATENT DOCUMENTS

FR 2700452 B1 7/1994

*Primary Examiner* — Robert Canfield
(74) *Attorney, Agent, or Firm* — Benoît & Côté Inc.

(57) ABSTRACT

A foldable multifunction chair including a base for contacting a support surface; a user body support having a support front surface for contacting a user body, the user body support being adjustably pivotably mounted to the base along a transversal axis; a selectively adjustable chair deployment mechanism cooperatively coupled to the base and the user body support, the chair deployment mechanism being configured for selectively adjusting the user body support to a desired angle relative to the base; and a locking mechanism configured for angularly locking the user body support to the desired angle relative to the base. The chair may be used, e.g., as a backrest with an accessory support positioned in front thereof for work, or as a seated workstation wherein the accessory support is positioned adjacent a rear surface of the user body support in a deployed position, and the collapsible seat in a deployed position.

6 Claims, 21 Drawing Sheets

(51) Int. Cl.

| | |
|---|---|
| ***A47C 1/029*** | (2006.01) |
| ***A47C 1/032*** | (2006.01) |
| ***A47C 1/035*** | (2006.01) |
| ***A47C 3/16*** | (2006.01) |
| ***A47C 4/28*** | (2006.01) |
| ***A47C 1/025*** | (2006.01) |
| ***A47C 1/14*** | (2006.01) |
| ***A47C 1/034*** | (2006.01) |
| ***A47C 1/031*** | (2006.01) |
| ***A47C 1/02*** | (2006.01) |
| ***A47C 7/50*** | (2006.01) |
| *A47C 7/54* | (2006.01) |
| *A47C 1/03* | (2006.01) |
| *A47C 7/02* | (2006.01) |
| *A47C 7/38* | (2006.01) |
| *A47C 1/026* | (2006.01) |

(52) U.S. Cl.

CPC ..... *A47C 1/143* (2013.01); *A47C 3/16* (2013.01); *A47C 4/28* (2013.01); *A47C 7/50* (2013.01); *A47C 7/506* (2013.01); *A47C 1/026* (2013.01); *A47C 1/0308* (2018.08); *A47C 7/0213* (2018.08); *A47C 7/38* (2013.01); *A47C 7/543* (2013.01)

(56) References Cited

U.S. PATENT DOCUMENTS

| | | | | |
|---|---|---|---|---|
| 3,266,061 | A | 8/1966 | Fuechsel | |
| 4,500,134 | A * | 2/1985 | Kaneko | A61G 15/14 297/173 |
| 5,466,039 | A | 11/1995 | Umbrianna | |
| 5,622,403 | A * | 4/1997 | Gonda | B63B 7/06 297/423.46 |
| 5,653,499 | A * | 8/1997 | Goodall | A47B 83/02 297/173 |
| 5,909,864 | A * | 6/1999 | Wang | A47B 83/02 297/173 |
| 5,951,105 | A * | 9/1999 | Slettebø | A47C 1/034 297/423.26 |
| 6,092,868 | A | 7/2000 | Wynn | |
| 6,422,646 | B1 * | 7/2002 | McNally | A47C 7/70 297/161 |
| 8,371,653 | B2 | 2/2013 | Albecker, III | |
| 9,578,972 | B2 | 2/2017 | Purintun | |
| 9,603,453 | B2 * | 3/2017 | Hoffman | A47C 1/03211 |
| 9,980,575 | B2 * | 5/2018 | Dewert | A47C 20/042 |
| 11,291,598 | B2 * | 4/2022 | Sielski | A61G 5/1056 |
| 2005/0039263 | A1 * | 2/2005 | Reed | A61G 7/015 5/618 |
| 2008/0246313 | A1 | 10/2008 | Boyco | |
| 2011/0031785 | A1 * | 2/2011 | Steenson | A47C 7/543 297/161 |
| 2016/0037937 | A1 * | 2/2016 | Dewert | A47C 1/0242 5/616 |
| 2017/0208952 | A1 * | 7/2017 | Simon | A47C 7/004 |
| 2017/0303692 | A1 * | 10/2017 | Rogers, Jr. | A47C 1/03211 |
| 2019/0125599 | A1 * | 5/2019 | Mulhern | A61G 5/1075 |
| 2019/0216220 | A1 * | 7/2019 | Griggs, Jr. | F16H 25/20 |

* cited by examiner

FOLDABLE MULTIFUNCTION CHAIR

CROSS-REFERENCE TO RELATED APPLICATIONS

This application claims priority under 35USC§ 119(e) of U.S. provisional patent application No. 62/840,790 filed on Apr. 30, 2019, the specification of which is hereby incorporated by reference.

BACKGROUND

(A) Field

The present invention relates generally to chairs and, more particularly to a foldable multifunction chair that can adopt a diversity of configurations suitable for rest, leisure, and desk work, as well as capable of adopting a substantially compact folded format for ease of transport and shipping through parcel mail.

(b) Related Prior Art

Foldable chairs and, more particularly legless foldable chairs consisting essentially of an adjustable backrest that is configured to rest directly on the floor or ground, are known. This type of light and compact foldable chair is often convenient to carry around and use on the beach, camp ground, home, school and in gymnasium during particular exercises.

In some instances, such backrest type foldable chair generally comprises a base, a backrest adjustable at a user selected angle relative to the base, and a cushioned mat laid over the front of the backrest and extends along the ground for greater comfort.

While these known foldable chairs of the prior art can generally fulfill the main objective of providing an adjustable backrest that can be easily carried around, they are also relatively limited in terms of varied comfortable postures that a user can take advantage of.

Furthermore, these known foldable chairs of the prior art are also relatively limited in terms functionality or usage possible that can be achieved by a user. For example, they generally cannot provide an office desk like posture and configuration for a user who desires to do desk work or similar tasks in a typically seated posture for ease of controlling a mouse and keyboard.

U.S. Pat. No. 9,578,972B2 describes in a broad sense a chair with an arm (98) supporting a tablet that is adjustable to its attachment point (100) on the side of the backrest, as well as to the attachment point (102) with the tablet. There is no specified limit angle for the attachment points (100 and 102), and the arm (98) is not telescopic. Moreover, the chair itself has nothing in common with the chair of the present invention.

U.S. Pat. No. 6,092,868A discloses a chair with a telescopic arm (25) that swivel at a pivot point (27) on the side of the back as well as with the tablet. There is no specified limit angle around the swivel points. The chair itself shares nothing in common the chair of the present invention.

U.S. Pat. No. 3,266,061A, US20080246313A1 and U.S. Pat. No. 5,466,039A describe lounge chairs with adjustable elbow supports connected from each sides of their portion of the headrest, thus allowing a person to lie on his stomach, for example, to read. However, these elbow supports are not fully folded down to conceal them in the back surface of the back, as for the chair of the present invention. The structure of the chairs themselves have nothing in common with the chair of the present invention.

U.S. Pat. No. 8,371,653 describes a leisure chair with armrests that enable a user to sit very close to floor level with side base front supports that extend forwards further than the backrest connection means. However, this chair is not configurable for transportation and does not have wheels and a securing means for securing any of the cushioned portions thereof, such as the backrest, cushioned seat, and ottoman portions, to the chair so that the cushioned portions are compactly folded for transportation. The French Patent No. FR2700452B1 describes a tethering system that allows various angle configurations between cushioned segments to form a seat at a right-angle or a "Z" seat. However, these fasteners are flexible, while the ones of the present invention differ significantly in that they require to be rigid when the backrest is at a sharp angle for the chair of the present invention.

Thus, there is a need on the market for an improved foldable chair of the backrest type that avoids the aforementioned disadvantages.

In a broad aspect, the present invention provides such an improved foldable chair.

SUMMARY

According to an embodiment, there is provided a foldable multifunction chair, comprising:

- a base for contacting a support surface;
- a user body support having a support front surface for contacting a user body, the user body support being adjustably pivotably mounted to the base along a transversal axis;
- a selectively adjustable chair deployment mechanism cooperatively coupled to the base and the user body support, the chair deployment mechanism being configured for selectively adjusting the user body support to a desired angle relative to the base; and
- a locking mechanism configured for angularly locking the user body support to the desired angle relative to the base.

According to another embodiment, the chair deployment mechanism comprises at least one longitudinal rail and a support structure, the longitudinal rail extending between a base forward end and a base rearward end of the base, the support structure having a first support end and a second support end, the first support end being pivotally mounted to a support rear surface of the user body support, the second support end being slidably mounted along the longitudinal rail, and wherein slidably moving the second support end along the longitudinal rail selectively adjusts the user body support to a desired angle relative to the base.

According to another embodiment, the selectively adjustable chair deployment mechanism further comprises a biasing element configured for biasing the second support end of the support structure substantially forwardly towards the base forward end of the base.

According to another embodiment, the locking mechanism comprises a actuable lock pin element and a pin biasing element, the actuable lock pin element and the pin biasing element being movably mounted to the second support end of the support structure, the pin biasing element being capable of biasing the actuable lock pin element towards a series of stop holes disposed along the longitudinal rail, and wherein biasing the actuable lock pin element toward a corresponding stop hole removably engages the actuable lock pin element with the corresponding stop hole to selectively lock in place the second support end of the support structure along the longitudinal rail.

According to another embodiment, the the locking mechanism comprises longitudinal slot and a rotatable locking element rotatably mounted transversally along the second support end of the support structure, the longitudinal slot extending between the base forward end and the base rearward end of the base, the rotatable locking element comprising a stem and at least one butterfly button affixed at a corresponding end of the stem, the rotatable locking element being freely movable along the longitudinal slot when the wings of the butterfly button are generally parallel relative to the longitudinal slot, the rotatable locking element being movably constrained along the longitudinal slot when the wings of the butterfly button are generally perpendicular relative to the longitudinal slot so that to removably engage corresponding recesses defined along the longitudinal slot and selectively lock in place the second support end of the support structure along the longitudinal slot.

According to another embodiment, the chair deployment mechanism comprises at least one length adjustable element having a first end portion and a second end portion, the first end portion being pivotally mounted to the support rear surface of the user body support, the second end portion being pivotally mounted to the base, and wherein varying the longitudinal length of the length adjustable element selectively adjusts the user body support to a desired angle relative to the base.

According to another embodiment, the locking mechanism is integrated in the length adjustable element and is selectively activated or deactivated via an element located at a user reachable location on the chair.

According to another embodiment, the selectively adjustable chair deployment mechanism comprises a motor means and a transmission means, the motor means being operatively coupled to the transmission means, the transmission means being operatively coupled to a pivot axis of the body support, and wherein activating the motor means selectively adjusts the user body support to a desired angle relative to the base.

According to another embodiment, the motor means comprises an electric motor and the transmission means comprises a worm gear transmission.

According to another embodiment, the foldable multifunction chair further comprises a collapsible seat pivotably connected to the base and user selectively movable between a collapsed and substantially flat positions.

According to another embodiment, the foldable multifunction chair further comprises a double-sided cushioned mat extension having a first proximal end and a second distal end, a securing means, the securing means being configured for securing the first proximal end to the second distal end of the double-sided cushioned mat extension.

According to another embodiment, the foldable multifunction chair further comprises an arm assembly coupled to a user accessory support, the arm assembly comprising a telescopically adjustable section and a selectively adjustable pivot joint for selectively positioning the user accessory support relative to the chair.

According to another embodiment, the foldable multifunction chair further comprises any one of an armrest, a retractable forearm support, a retractable retractable elbow, and a retractable neckrest and headrest.

According to another embodiment, the selectively adjustable chair deployment mechanism configures the chair in over ten distinctive positions.

According to an embodiment, there is provided a foldable multifunction chair, comprising:

a base for contacting a support surface, the base having at least one longitudinal rail extending between a base forward end and a base rearward;

a user body support having a support front surface for contacting a user body, the user body support being adjustably pivotably mounted to the base along a transversal axis;

a selectively adjustable chair deployment mechanism cooperatively coupled to the base and the user body support, the chair deployment mechanism including:

a support structure comprising at least one pivot leg, at least one slide leg, a motor means, and a transmission means, the pivot leg having a first pivot leg end pivotally mounted to the base and a second pivot leg end mounted to the body support, the slide leg having a first slide leg end slidably and pivotally mounted to the longitudinal rail and a second slide leg end pivotally mounted to the body support, the motor means being operatively coupled to the transmission means, the transmission means being operatively coupled to the first slide leg end, wherein activating the motor means longitudinally moves the first slide leg end along the longitudinal rail and selectively adjusts the distance between the user body support and the base;

a length adjustable element having a first element end and a second element end, the first element end being pivotally mounted to the support rear surface of the user body support, the second element end being pivotally mounted to the base, wherein varying the longitudinal length of the length adjustable element selectively adjusts the user body support to a desired angle relative to the base; and a support structure locking mechanism configured for angularly locking the user body support to the desired angle relative to the base.

According to another embodiment, the motor means comprises an electric motor and the transmission means comprises a worm gear transmission.

According to another embodiment, the foldable multifunction chair further comprises a plurality of mounting holes disposed on each of the second slide leg end of the slide legs, each of the plurality of mounting holes being configured for selectively and removably mounting the second pivot leg end of a corresponding pivot leg so as the distance of the user support body relative to the base when the selectively adjustable chair deployment mechanism is in a deployed position is selectively adjustable.

The foldable multifunction chair may further comprise a support mat for covering the support front surface of the user body support front, a first seat mat segment, a second seat mat segment, and a mat securing means. The first seat mat segment may be selectively pivotally mounted to the user body support, the second seat mat segment may be selectively telescopically and selectively pivotally mounted to the first seat mat segment. The securing means may be configured for securing at least one of the support mat, the first seat mat segment, and the second sat mat segment with the other or to the chair.

According to another embodiment, the foldable multifunction chair further comprises an arm assembly coupled to a user accessory support, the arm assembly comprising a telescopically adjustable section and a selectively adjustable pivot joint for selectively positioning the user accessory support relative to the chair.

According to another embodiment, the foldable multifunction chair further comprises any one of an armrest, a retractable forearm support, a retractable retractable elbow, and a retractable neckrest and headrest.

According to another embodiment, the selectively adjustable chair deployment mechanism configures the chair in over ten distinctive positions.

According to an embodiment of the present invention, the multifunction chair comprises a base extending longitudinally on a support surface.

The multifunction chair further comprises a body support having a body support proximal end adjustably pivotably supported along a transversal axis by a forward end of the base, and a body support distal end extending radially therefrom.

The multifunction chair further comprises an arm assembly comprising an elongated telescopic arm having a telescopic arm proximal end adjustably pivotably mounted along a longitudinal side of the body support, and a telescopic arm distal end extending radially therefrom.

The multifunction chair further comprises a user accessory support adjustably pivotably mounted at the telescopic arm distal end.

The multifunction chair further comprises a collapsible seat having a lower portion thereof pivotably mounted at a rearward end of the base.

The body support is selectively pivotable between a chair folded position, wherein the body support is substantially parallel to the base, and a chair deployed position, wherein the body support is pivotally spaced apart from the base.

The arm assembly is capable of selectively adopting a position so as to have the accessory support located at a position substantially in close proximity with a rear surface of the body support, an adjacent position relative to the rear surface of the body support, an adjacent position relative to the body support distal end, and an adjacent position relative to a front surface of the body support.

The collapsible seat is selectively movable between a seat collapsed position, wherein the collapsible seat is capable of adopting a substantially flat configuration within, and substantially in register with, an imaginary horizontal plane of the base, and a seat deployed position, wherein the collapsible seat is deployed and resting on the support surface adjacently the rearward end of the base.

Thus, with the collapsible seat in the seat collapsed position, the arm assembly positioned so as to have the accessory support in close proximity with the rear surface of the body support, and the body support in the body support folded position, the multifunction chair forms a substantially compact format for ease of transport through parcel mail, or for a user to rest substantially horizontally with his or her rear upper body resting on the front surface of the body support.

Furthermore, with the collapsible seat in the seat collapsed position, the arm assembly positioned so as to have the accessory support adjacent the body support distal end, and the body support in the body support folded or slightly deployed position, a user may rest with his or her upper front body on the body support and use a support surface connected to the accessory support for leisure reading or work.

Furthermore, with the collapsible seat in the seat collapsed position, the body support in the body support deployed position, and the arm assembly positioned so as to have the accessory support adjacent the body support front surface, a user may be seated on the support surface and use the body support front surface as a backrest, and use a support surface connected to the accessory support for leisure reading or work in front of him or her.

Furthermore, with the collapsible seat in the seat collapsed position, the body support in the body support deployed position, and the arm assembly positioned so as to have the accessory support adjacent the body support rear surface, a user may stand up behind the accessory support and use a support surface connected to the accessory support to use the multifunction chair as a typical stand up workstation.

Still furthermore, with the body support in the body support deployed position, the collapsible seat in the seat deployed position, and the arm assembly positioned so as to have the accessory support adjacent the body support rear surface, a user may be seated on the collapsible seat and use a support surface connected to the accessory support to use the multifunction chair as a typical seated workstation.

Other positions of the accessory support relative to the body support are also possible.

These possible positions of the accessory support allow a user to conveniently position his or her accessory at a most convenient location for leisure activities or for desk work activities.

These possible positions of the accessory support further allow a user to conveniently position the accessory support at a most unobstructive position close to the body support rear surface, or conveniently positioned out of the way above the body support distal end.

The components of the various embodiments of the foldable multifunction chair described heretofore may be made of materials well known in the home and office furniture industry. Preferably, the materials used are substantially light weight, yet sufficiently rigid and robust as the chair inherently represents a movable furniture typically designed to support an adult.

Thus, there has been described heretofore various embodiments of a new and inventive assembly for a foldable multifunction chair that allows a user to adopt various comfortable postures for a restful rest, entertainment, or desk work. None of the known backrest type of comparable foldable chairs, such as legless foldable beach chairs and the like, can achieve so many possibilities in terms of comfortable user postures and functional utility of the chair.

Other advantages, novel features and alternate embodiments of the present invention will be more apparent from the following drawings and detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
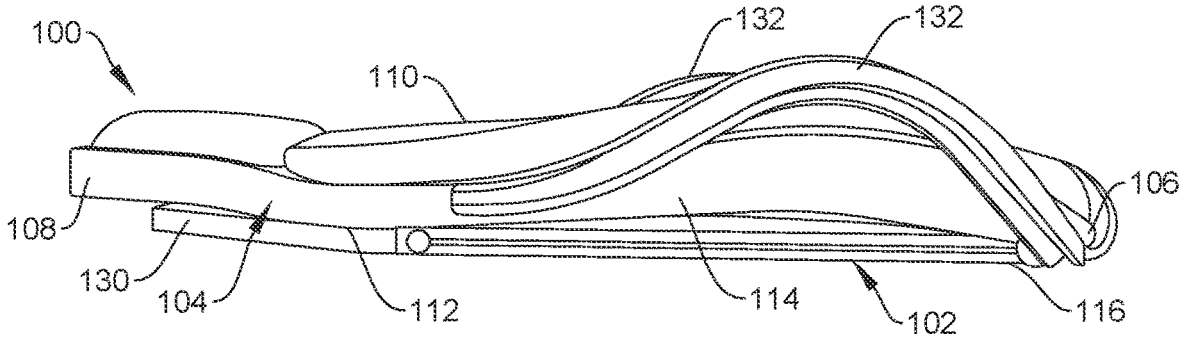
FIG. 1, in a side view, illustrates an embodiment of a foldable multifunction chair, according to the present invention, here shown in a folded position.

FIGS. 1 to 6, inclusively, illustrate various aspects of an embodiment, according to the present invention, of a foldable multifunction chair 100, hereinafter referenced more simply as the chair 100.

The chair 100 comprises a base 102 extending longitudinally and substantially parallelly relative to a support surface.

The chair 100 further comprises a body support 104 having a body support proximal end 106, a body support distal end 108, a body support front surface 110, a body support rear surface 112 and opposed body support longitudinal sides 114.

The body support 104 is pivotably supported along a transversal axis through its body support proximal end 106 by a forward end 116 of the base 102, with the body support distal end 108 extending radially therefrom.

The body support 104 is selectively pivotable between a chair folded position wherein the body support 104 is substantially parallel to the base 102, as illustrated in FIG. 1, and a chair deployed position wherein the body support 104 is pivotally spaced apart from the base 102, as illustrated in FIGS. 2 to 6;

The chair 100 further comprises an arm assembly 118. The arm assembly 118 includes an elongated telescopic arm 120 having a telescopic arm proximal end 122 and a telescopic arm distal end 124.

Figure 5:
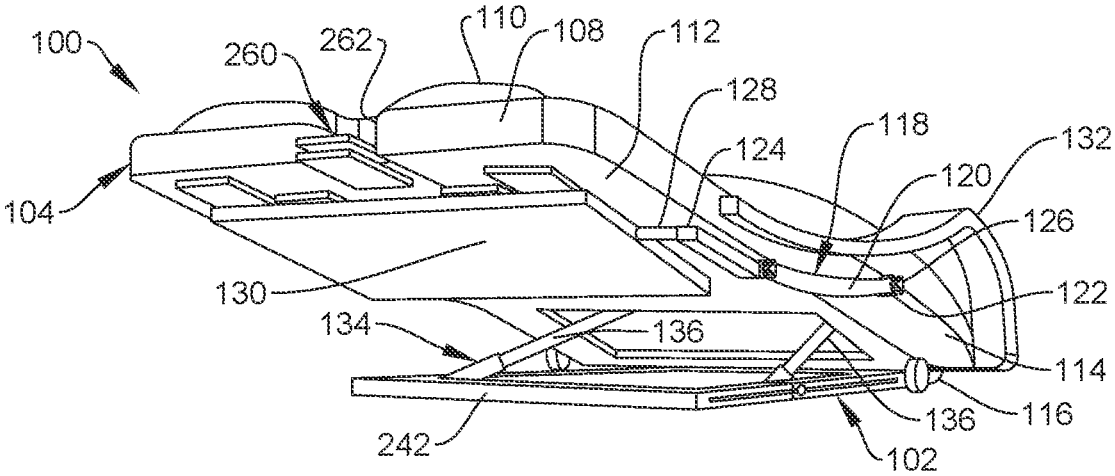
FIG. 5, in a rear-end perspective view, illustrates the chair in FIG. 2.
Figure 10:
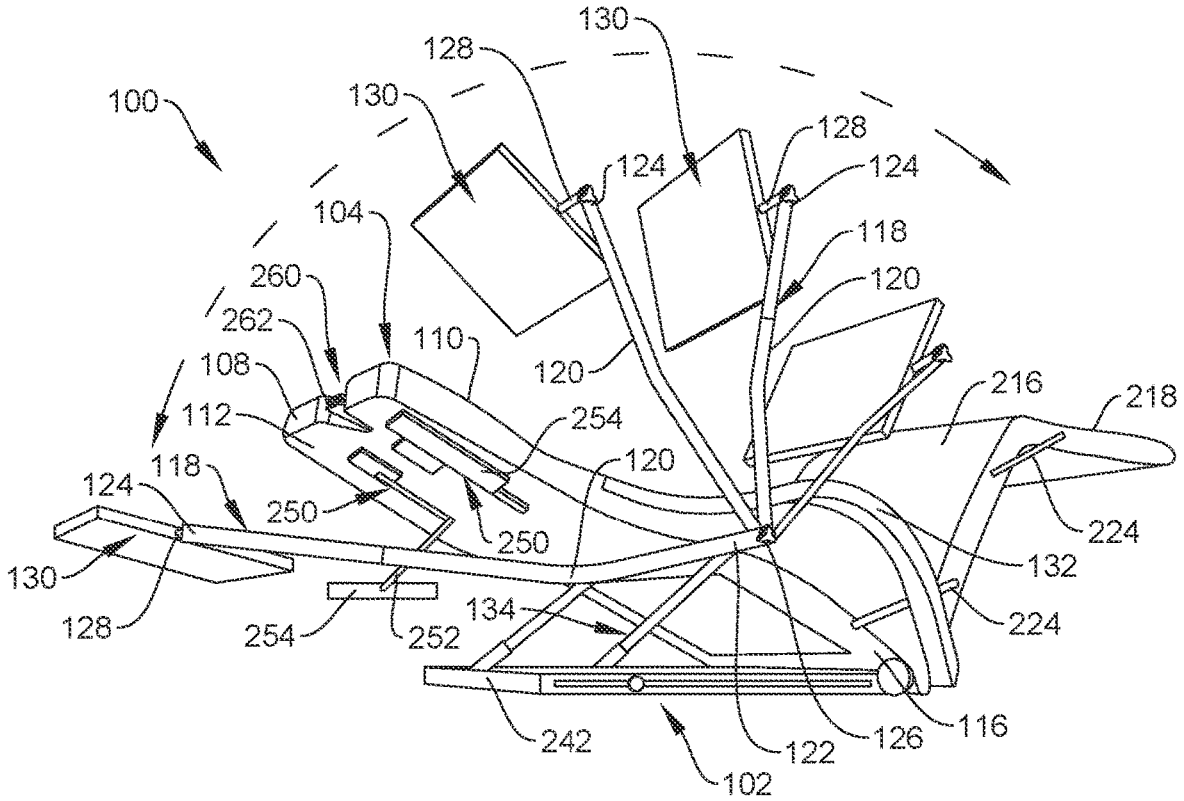
FIGS. 10 to 17, in various perspective views, illustrate the chair in FIG. 2 with its body support, foldable padded mat, support arm assembly with accessory, forearm support, and a retractable lamp, each in various possible states of deployment, position and usage.

The telescopic arm 120 is movable between a telescopic arm retracted position, as illustrated in FIG. 5, and a telescopic arm extended position, as illustrated in FIG. 10.

The arm assembly 118 further includes a first selectively adjustable pivot joint 126 at the telescopic arm proximal end 122. The first selectively adjustable pivot joint 126 is connected along one of the body support longitudinal sides 114 or along the body support rear surface 112.

Figure 12:
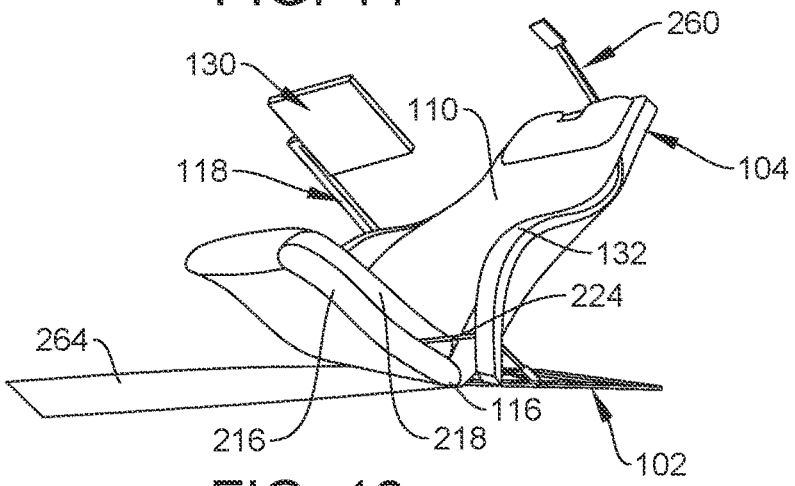

Preferably, as illustrated throughout the figures, the first selectively adjustable pivot joint 126 is connected at an intermediate location along the body support longitudinal side 114 that is to the right of a user seated in the chair 100 illustrated, for example, in FIG. 12.

The arm assembly 118 further includes a second selectively adjustable pivot joint 128 at the telescopic arm distal end 124.

The chair 100 further comprises a user accessory support 130 connected to the second selectively adjustable pivot joint 128 of the arm assembly 118. The user accessory support 130 is configured for suitably supporting a user selected accessory such as, non limitatively, a writing surface, a computer device such as a laptop, a computer tablet, a computer tablet with a separate or detachable keyboard, a portable phone, a book, a food tray, a tool tray, or the likes.

Figure 9:
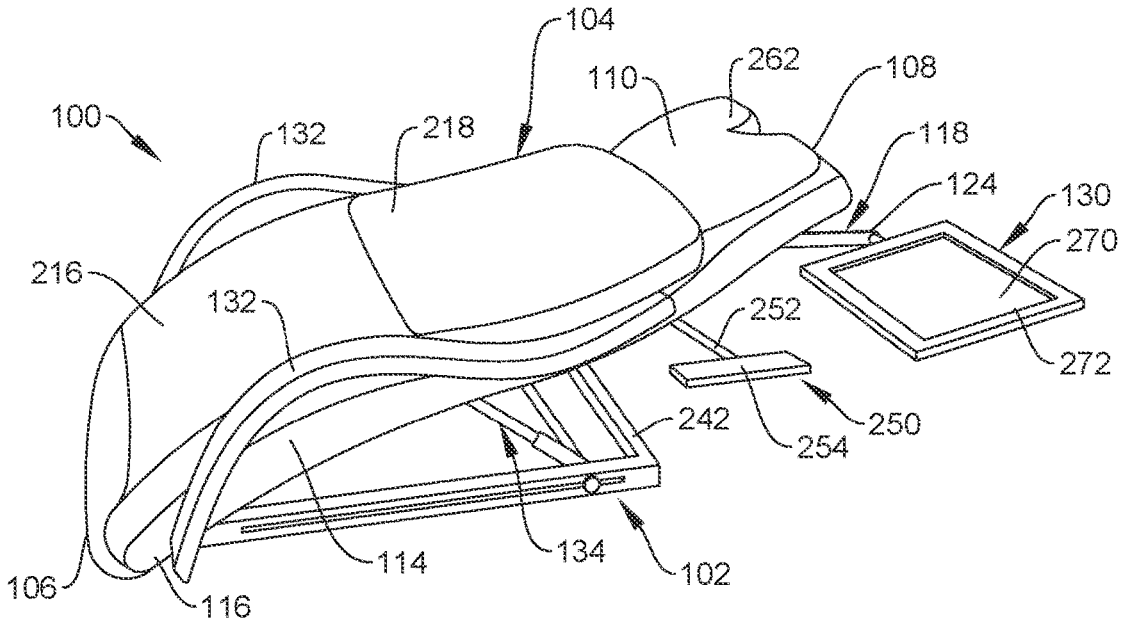
FIG. 9, in side perspective view, illustrates the chair, for example, in FIG. 3, here shown having a support arm assembly with accessory, and a forearm support, each in one possible state of a deployed position.
Figure 11:
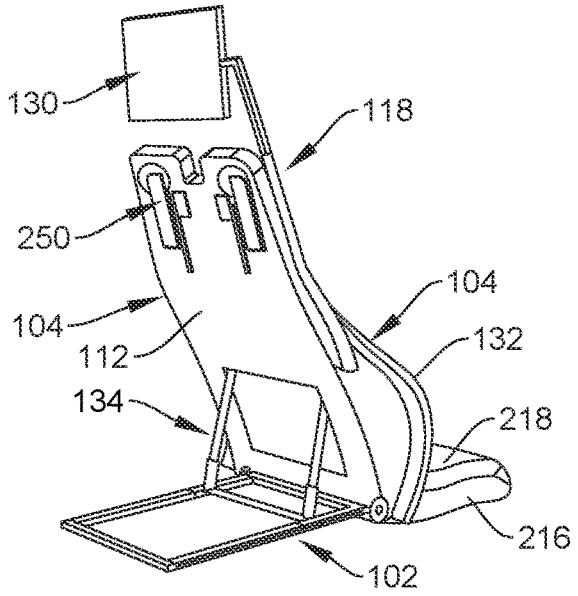
Figure 13:
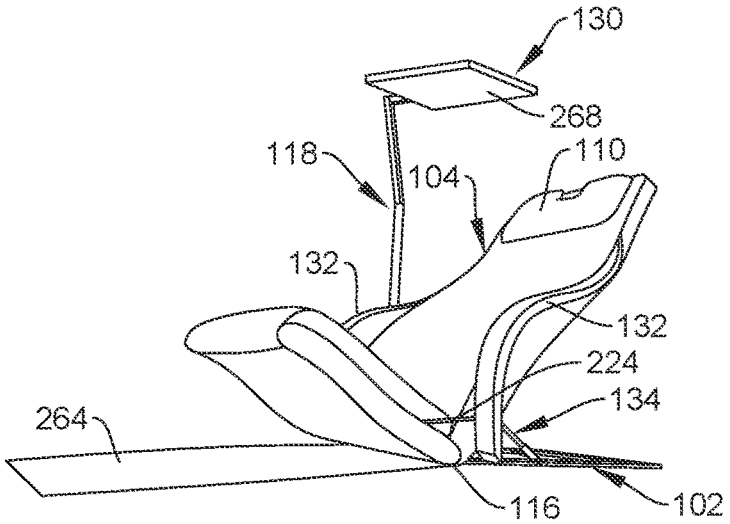
Figure 14:
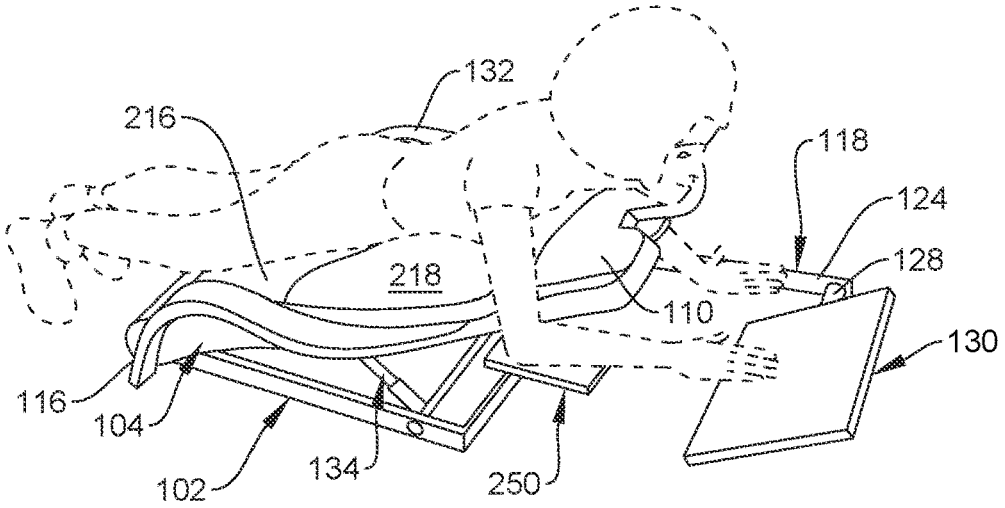
Figure 17:
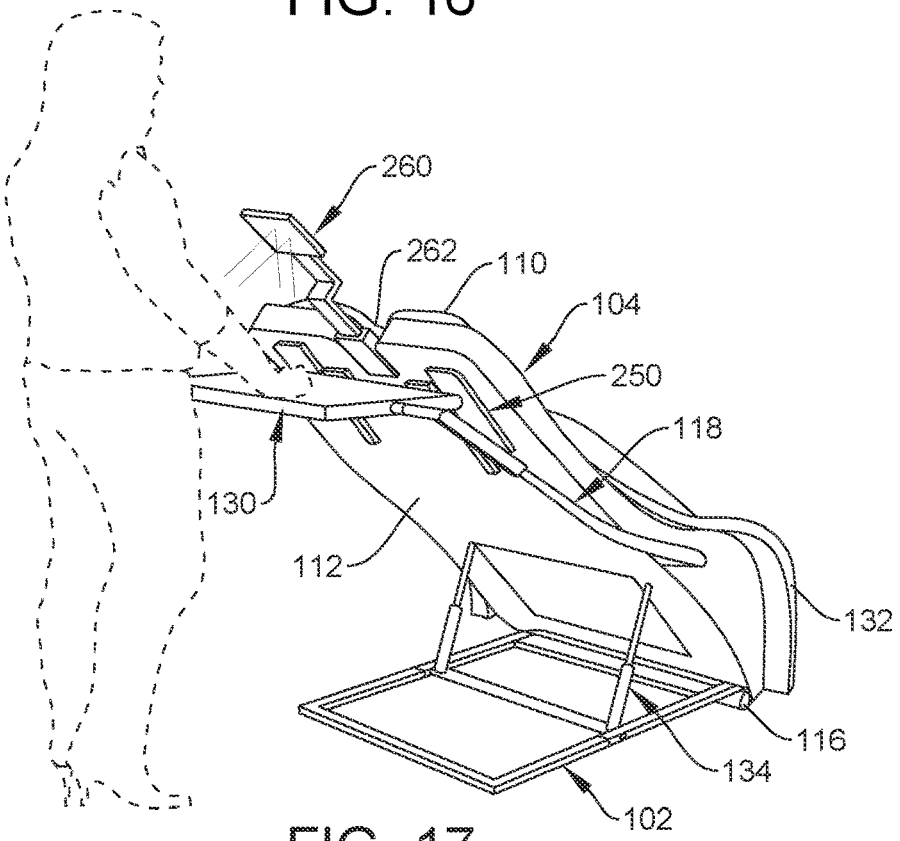
Figure 19:
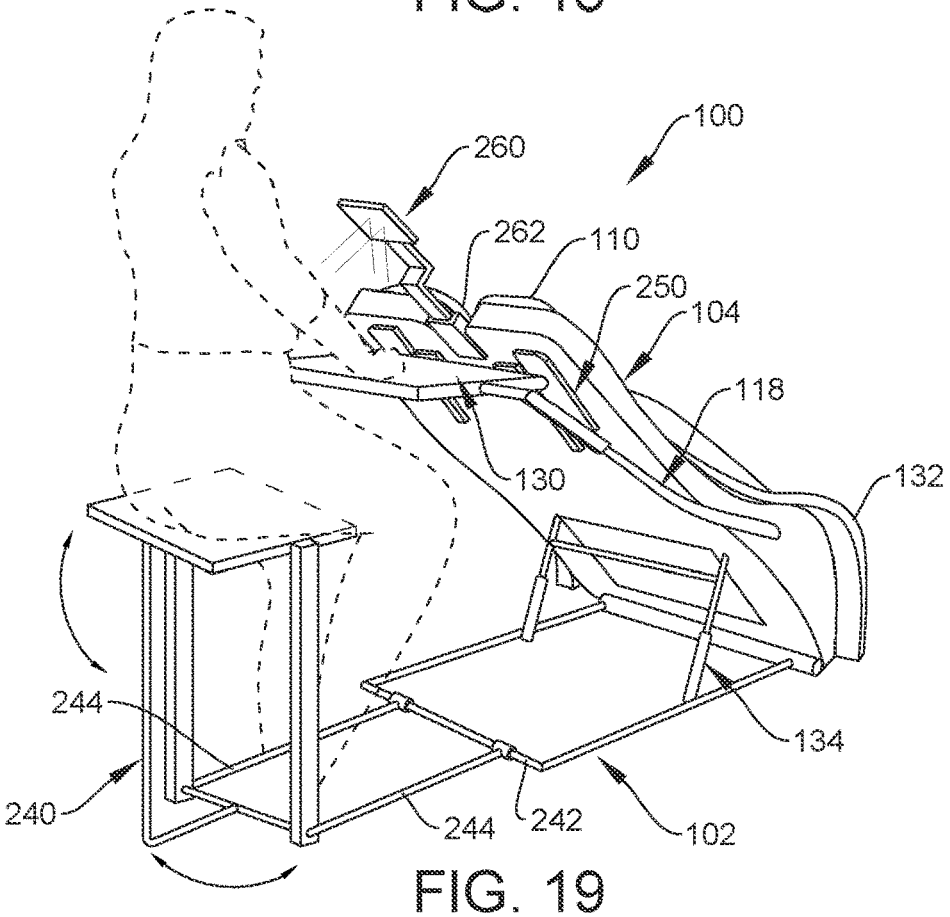
FIG. 19, in a rear-end perspective view, illustrates the chair in FIG. 2, here having a collapsible seat in a deployed position.

Thus, with the body support 104 in the body support deployed or folded position, as possible, the arm assembly 118 is capable of user selectively adopting a position so as to have the accessory support 130 located adjacently the body support front surface 110, as illustrated in FIGS. 12 and 13, the body support distal end 108, as illustrated in FIGS. 9, 11 and 14, and the body support rear surface 112, as illustrated in FIGS. 17 and 19.

The arm assembly 118 is further capable of user selectively adopting a position so as to have the accessory support 130 located in substantially close proximity with the body support rear surface 112, as illustrated in FIGS. 1, 5, 16 and 18 respectively.

Other positions of the accessory support 130 relative to the body support 104 are also possible.

These possible positions of the accessory support 130 allows a user to conveniently position his or her accessory at a most convenient location for leisure activities, such as suggested through FIGS. 9, 10, 12, 13, 14 and 15, or for work activities such as suggested in FIGS. 17 and 19.

These possible positions of the accessory support 130 further allow a user to conveniently position the accessory support 130 at a most non-obstructive position close to the body support rear surface 112, as illustrated in FIGS. 5, 8, 16 and 18, or conveniently positioned out of the way above the body support distal end 108, as illustrated in FIG. 11.

Figure 27:
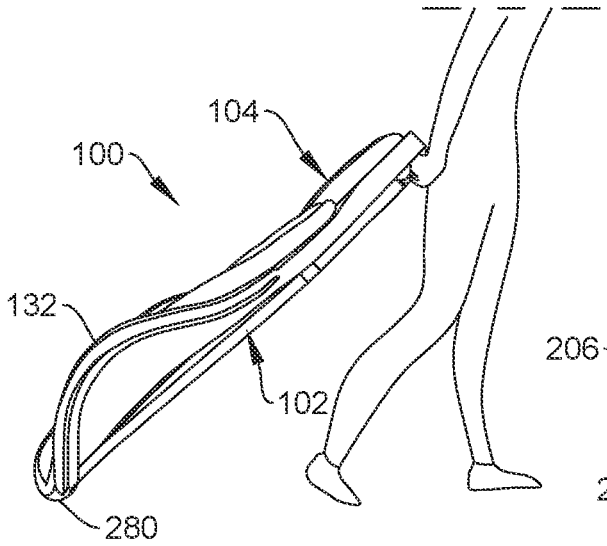
FIG. 27, in a side view, illustrates the chair in FIG. 1 having luggage wheels at one end thereof.

Furthermore, with the accessory support 130 positioned in proximity with the body support rear surface 112, and the body support 104 in a folded position, as illustrated in FIG. 1, the chair 100 may adopt a substantially compact format for ease of transport, as illustrated in FIG. 27, as well as for economic shipping through parcel mail.

In some embodiments of the invention, the base 102 and body support 104 have substantially similar length and width dimensions.

Preferably, the base 102 and the body support 104 may both have a length and width dimensions that are between substantially similar to, and slightly greater than, the length and width dimensions of a conventionally sized backrest of an office chair, depending on the model size of the chair 100, such as small, for young children, medium for teenager, and large for adults.

Further preferably, the body support 104 has its body support proximal end 106 pivotably supported substantially proximally at the forward end 116 of the base 102, so as to act as a backrest when in a deployed position, as illustrated in FIG. 11.

Other relative proportions and dimensions of the base 102 and the body support 104 are also possible.

Further preferably, the body support 104 may include suitably configured armrests 132 along each body support longitudinal sides 114.

Alternatively, the body support 104 may be free of any armrests, such as armerests 132 along each body support longitudinal sides 114.

Preferably, the chair 100 further comprises a selectively adjustable chair deployment mechanism 134 cooperative with the base 102 and the body support 104, for user selectively adjusting the body support 104 to a desired angle relative to the base 102.

Figure 23:
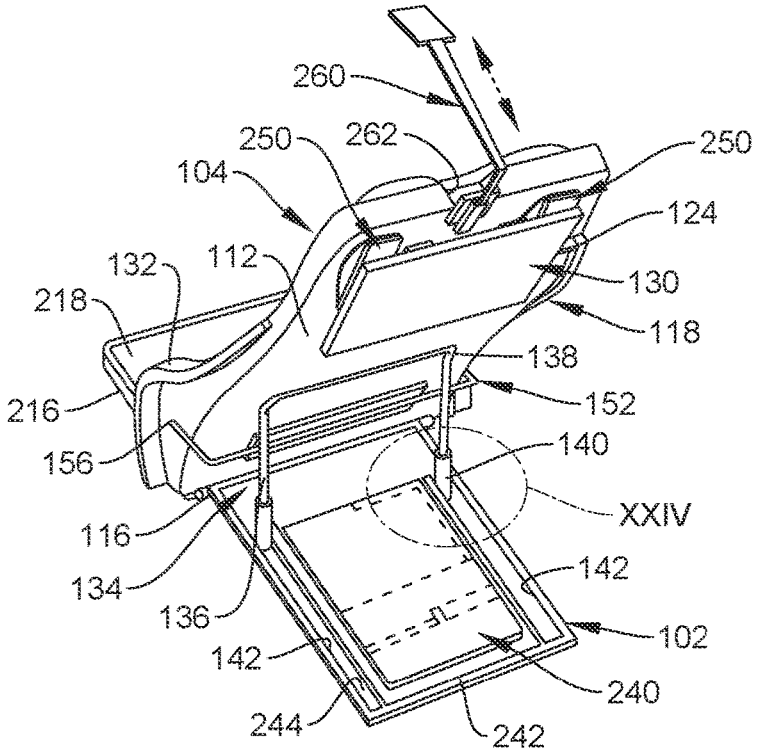
FIG. 23, in a rear perspective view, illustrates a foldable multifunction chair, according to the present invention, here having an embodiment of a selectively adjustable deployment mechanism including a locking mechanism and a spring element.
Figure 24:
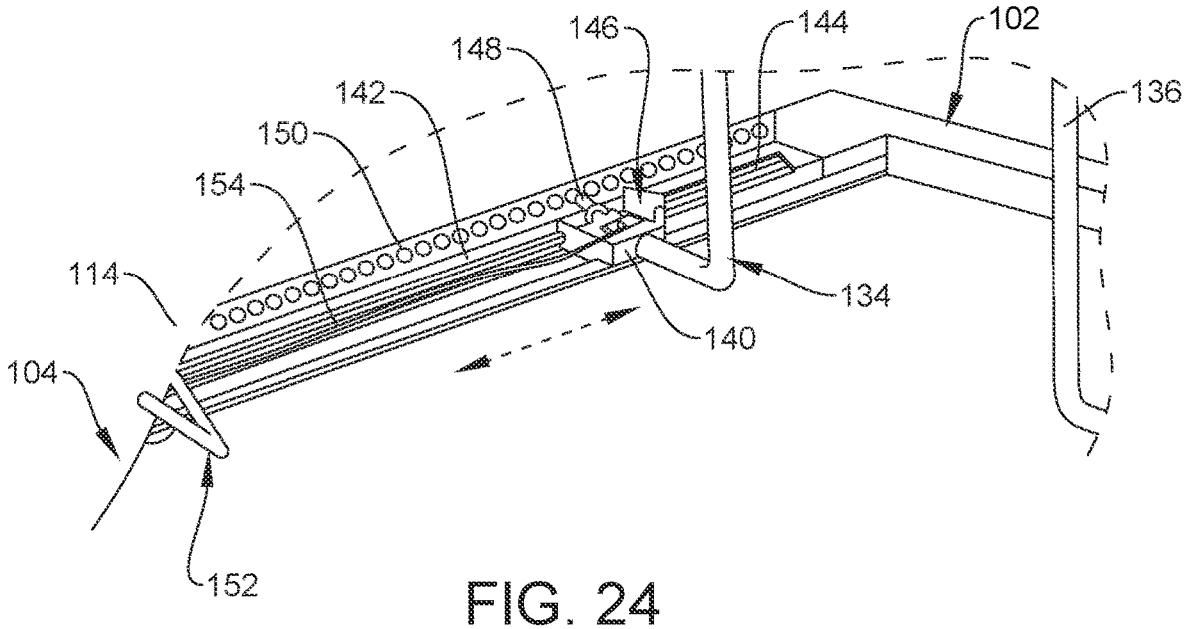
FIG. 24, in a partial perspective, enlarged view, illustrates a portion of the embodiment of a selectively adjustable deployment mechanism shown within section line XXIV in FIG. 23.

Referring to FIGS. 23 and 24, an embodiment of the chair deployment mechanism 134 includes a support structure 136 having a first end portion 138 pivotally supporting the body support 104 at an intermediate longitudinal location along the body support rear surface 112, and a second end portion 140 slidably mounted along a pair of longitudinal rails 142 oppositely disposed parallelly longitudinally on each side of the base 102.

The chair deployment mechanism 134 further includes a spring element 144, such as an elongated compression coil spring, as illustrated in FIG. 24, or equivalent, configured for urging the second end portion 140 of the support structure 136 substantially forwardly relative to the base 102.

The chair deployment mechanism 134 further includes a selectively locking mechanism 146. The locking mechanism 146 includes at least one actuable lock pin element 148 movably mounted on the support structure 136 and adjacently a respective rail 142.

The at least one lock pin element 148 is configured so as to be spring biased toward, and removably engageable with, a series of stop holes 150 distributed linearly parallelly along a longitudinal portion of the rail 142.

The locking mechanism 146 further includes a lever 152 and cable 154 combination, wherein the lever 152 is operatively mounted at a user reachable location on the body support 104, and the cable 154 operatively coupled between the lever 152 and the at least one lock pin element 146.

Thus, the support structure 136, the spring element 144, the lock pin element 146, and the lever 152 and cable 154 combination cooperate to allow a user having his or her back against the body support front surface 110 to actuate the lever 152 in order to selectively adjust the angle of the body support 104 relative to the base 102.

As illustrated in FIG. 23, the lever 152 may be a U-shaped member having its distally opposed ends 156 pivotably mounted on laterally opposed location on each body support longitudinal side 114, and extending transversally across the body support rear surface 112.

Other known types and configurations of levers are also possible.

Figure 25:
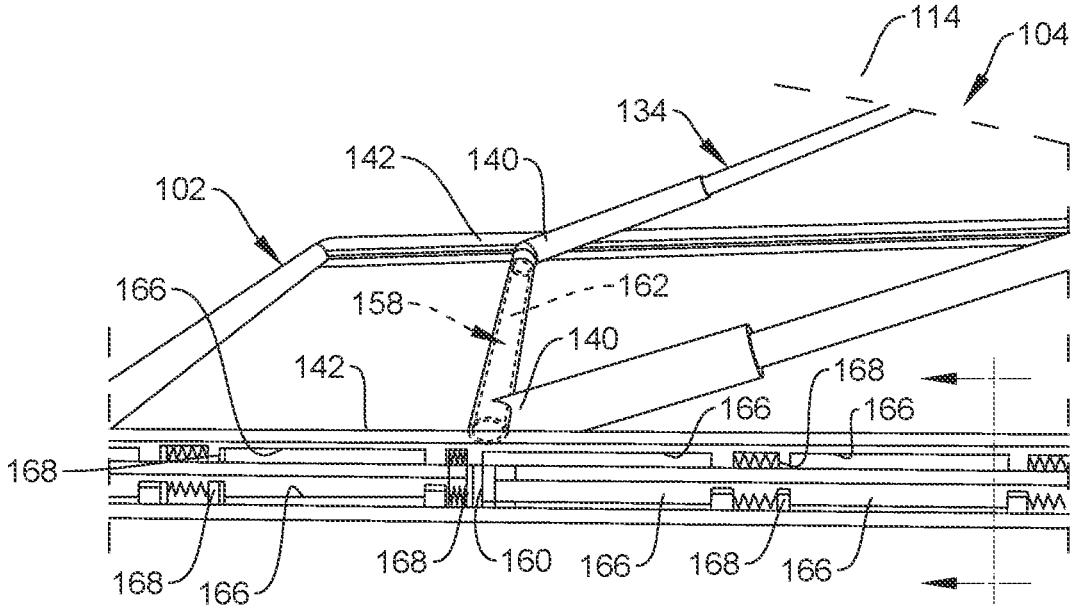
FIG. 25, in a side partial view, illustrates another embodiment of the locking mechanism.
Figure 26:
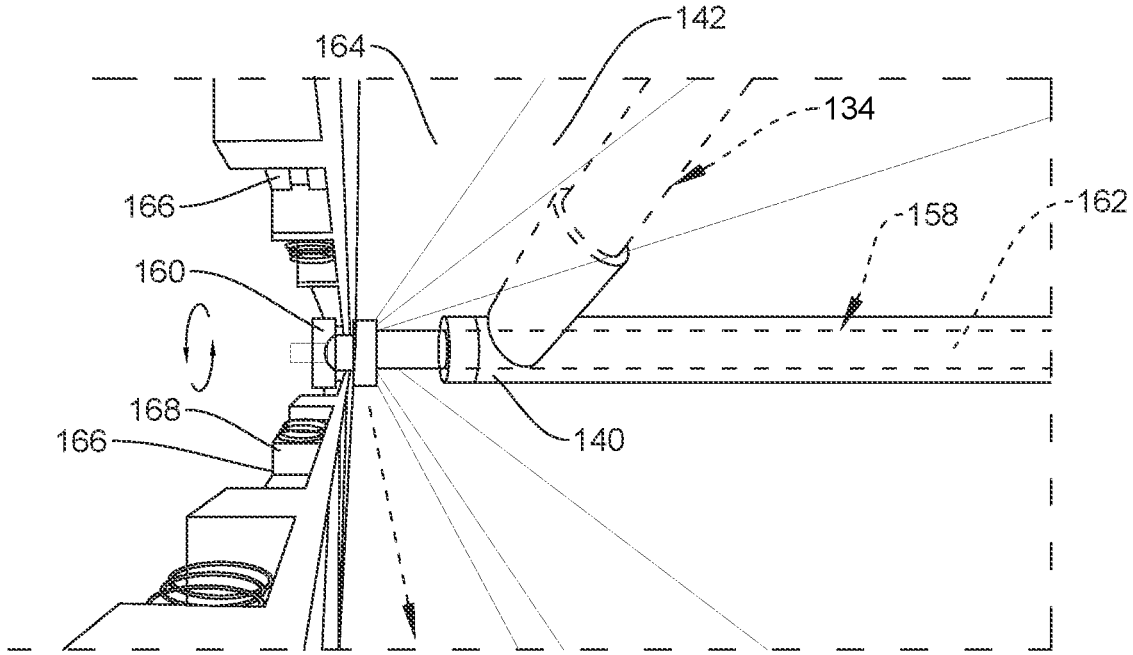
FIG. 26, in a partial front-end view, illustrates the other embodiment of the locking mechanism shown from section line XXV in FIG. 25.

Referring to FIGS. 25 and 26, another embodiment of a selectively locking mechanism 146 is illustrated. In the presently described embodiment, the locking mechanism 146 includes a rotatable locking element 158. The rotatable locking element 158 includes a pair of butterfly buttons 160 affixed at each end of a stem 162.

The rotatable locking element 158 is rotatably mounted transversally along the support structure second end 140, with each butterfly button 160 being user rotatably movable between a longitudinal orientation of its pair of wings, wherein the support structure second end 140 is freely slidably movable within a longitudinal slot 164 defined along each one in the pair of rails 142, and perpendicular orientation relative thereof, wherein the wings of each butterfly button 160 are movably constrained within one of a plurality of oppositely facing recesses 166 defined in a longitudinally spaced apart relationship along the slot 164.

Thus, by manually rotating the rotatable locking element 158, the user may selectively adjust the angle of the body support 104 between the body support folded and deployed positions relative to the base 102 by incremental steps along the slots 164 on each sides of the base 102.

Preferably, each oppositely facing recess 166 includes a spring biased element 168 for absorbing any abrupt movement of the support structure second end 140 within the slots 164 along the pair of rails 142.

Figure 18:
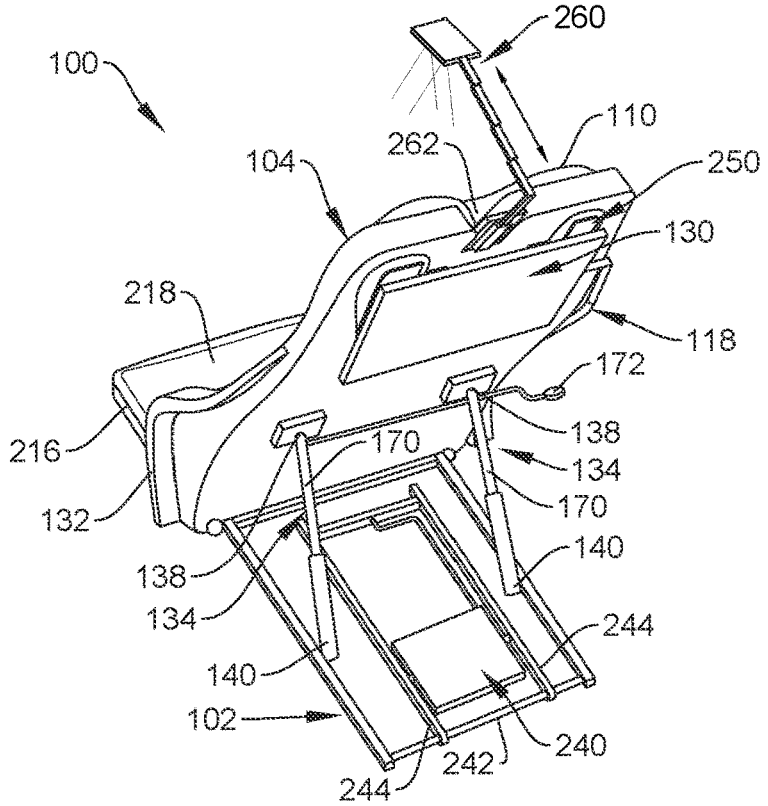
FIG. 18, in a rear-end perspective view, illustrate a foldable multifunction chair, according to the present invention, here having an embodiment of a selectively adjustable chair deployment mechanism in a deployed position including a support structure having length adjustable elements selectively releasable via a lever, as well as a collapsible seat in a collapsed position.

In some embodiments of the invention, as illustrated in FIG. 18, the support structure 136 is length adjustable through one or more length adjustable elements 170, such as a pair of length selective telescopic cylinders including hydraulic and/or pneumatic cylinder, that are selectively releasable via a suitable lever 172 located at a user reachable location, for example, adjacent one of the body support longitudinal sides 114.

Thus, a user may further fine adjust the angle of the body support 104 between the body support folded and deployed positions relative to the base 102.

Figure 22:
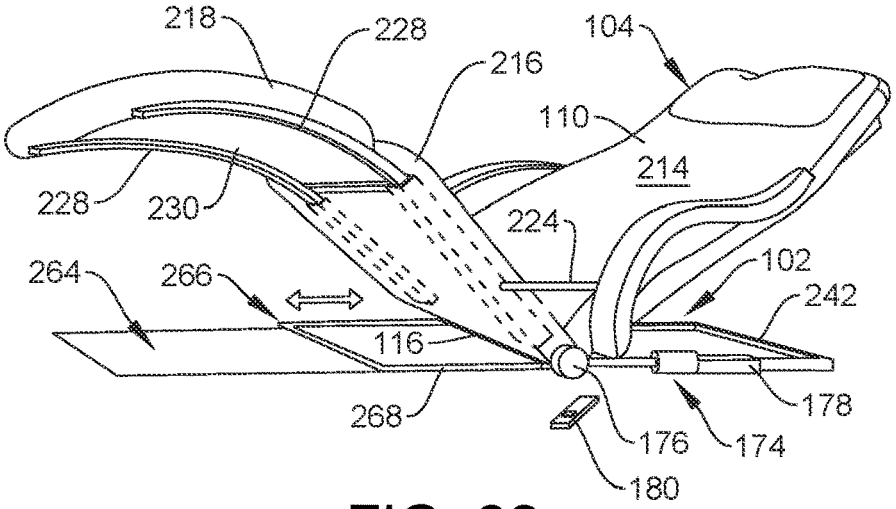
FIG. 22, in a front-end perspective view, illustrates a foldable multifunction chair, according to the present invention, here having an embodiment of a selectively adjustable chair deployment mechanism including a motor drive unit, a worm gear transmission, and a remote-control unit, as well as a retractable base extension.

FIG. 22 illustrates another embodiment of a selectively adjustable chair deployment mechanism 134 cooperative with the base 102 and the body support 104. The presently described chair deployment mechanism 134 includes a motor drive unit 174 including an electric motor mounted to the base 102 and operatively coupled to a worm gear transmission 176 which, in turn, is operatively coupled to a pivot axis of body support 104.

Preferably, the motor drive unit 174 includes a rechargeable battery 178 or, alternatively, may be powered via a wall electrical outlet.

Further preferably, the motor drive unit 174 includes a wired or wireless remote-control unit 180 for controlling the latter.

Thus, a user may selectively adjust the angle of the body support 104 between the body support folded and deployed positions relative to the base 102.

FIGS. 32 to 48 illustrate another embodiment of the chair deployment mechanism 400 which includes a pair of pivot legs 402*a*, 402*b*, a pair of slide legs 404*a*, 404*b*, at least one motor drive unit 406, at least one worm gear transmission 408, and a user control interface (not shown in the figure).

Figure 33:
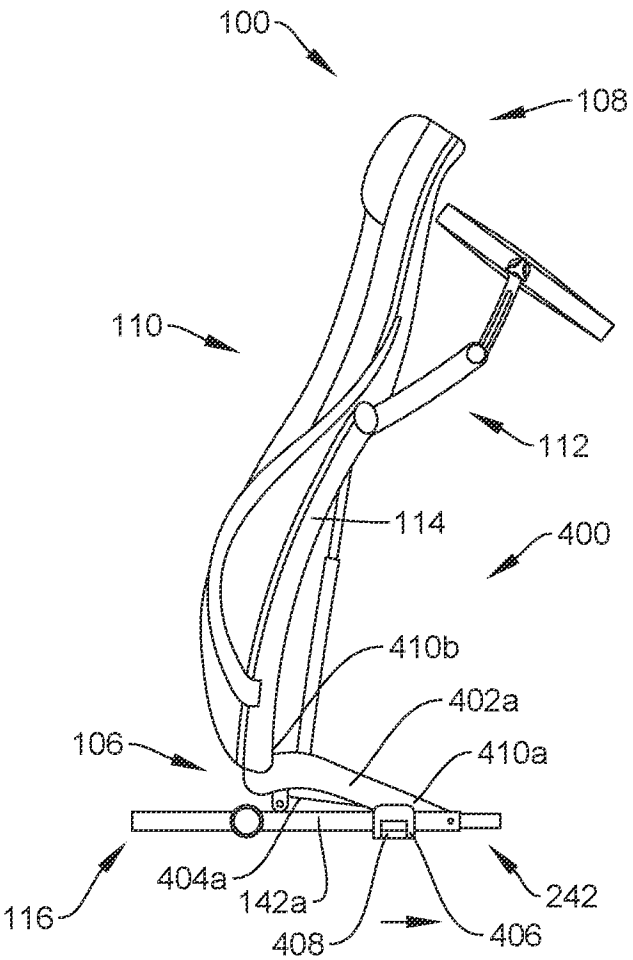
FIGS. 32 and 33, in side views, illustrate a foldable multifunction chair, according to the present invention, shown in a raised and lowered positions, respectively, here having an embodiment of a selectively adjustable deployment mechanism including pivotable legs, slidable legs, motor drive unit, gear transmission, and biasing cylinders.
Figure 32:
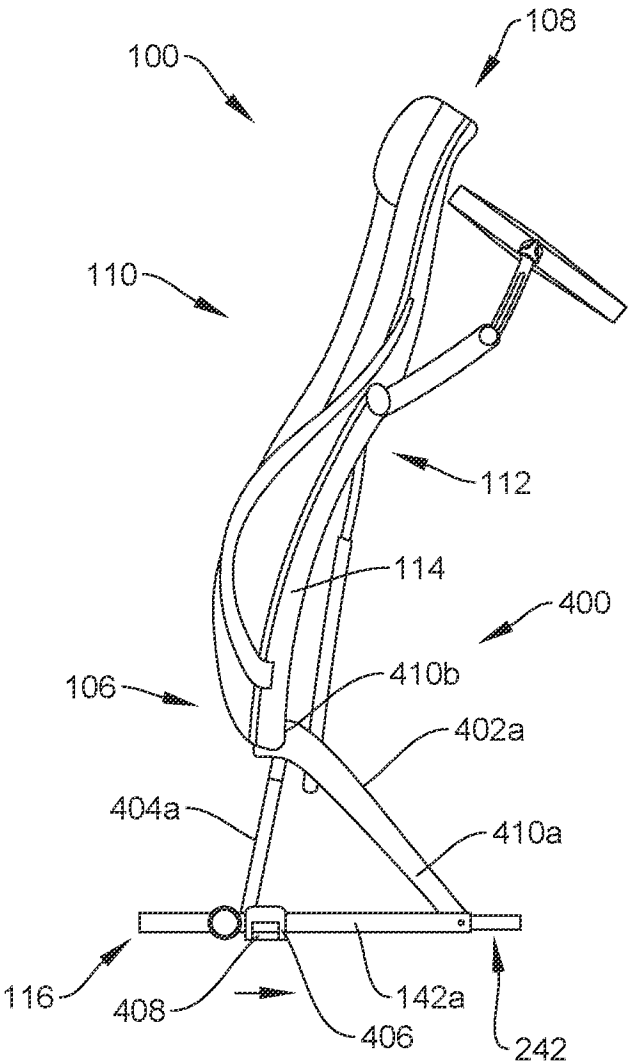

As illustrated in FIGS. 32 and 33, the pair of pivot legs 402*a*, 402*b* each have a first end portion 410*a* pivotally mounted proximal a rearward end 242 of the base 102, and a second end portion 410*b* connected proximal to the body support proximal end 106 and a corresponding opposed body support longitudinal sides 114 of the body support 104.

The pair of slide legs 404*a*, 404*b* each have a first end portion 412*a* slidably and pivotally mounted on a corresponding rail of the pair of longitudinal rails 142*a*, 142*b*, and a second end portion 412*b* pivotally connected proximal to the body support proximal end 106 and a corresponding opposed body support longitudinal sides 114 of the body support 104.

Each of the slide legs 404*a*, 404*b* may be selectively and pivotally mounted to a corresponding pivot legs 402*a*, 402*b* such that the distance between the body support 104 and the base 102 may be selectively adjusted when the chair deployment mechanism 400 is in a deployed position. To this end, each of the second end portion 412*b* of the slide legs 404*a*, 404*b* may comprise a plurality of mounting apertures, such as three mounting apertures, disposed longitudinally and spaced apart along a central axis portion thereof. Each of the second end portion 410*b* of the pivot legs 402*a*, 402*b* may be selectively removably mounted to a selected mounting aperture of a corresponding slide legs 404*a*, 404*b* by a mounting pin, such as a bolt pin and the like so as the pivot legs 402*a*, 402*b* pivot relative to the slide legs 404*a*, 404*b*.

For example, pivotally mounting the pivot legs 402*a*, 402*b* to a mounting aperture that is located distal to the first end portion 412*a* of a corresponding slide legs 404*a*, 404*b* would position the body support 104 at a greater distance from the base 102, as compared to pivotally mounting the pivot legs 402*a*, 402*b* to a mounting aperture that is located proximal to the first end portion 412*a* of the corresponding slide legs 404*a*, 404*b*. To the contrary, pivotally mounting the pivot legs 402*a*, 402*b* to a mounting aperture that is located proximal to the first end portion 412*a* of a corresponding slide legs 404*a*, 404*b* would position the body support 104 at a smaller distance from the base 102, as compared to pivotally mounting the pivot legs 402*a*, 402*b* to a mounting aperture that is located distal to the first end portion 412*a* of the corresponding slide legs 404*a*, 404*b*.

Thus, a user may selectively adjust the distance between the body support 104 and the base 102 when via the chair deployment mechanism 400 and the plurality of mounting apertures.

Figure 34:
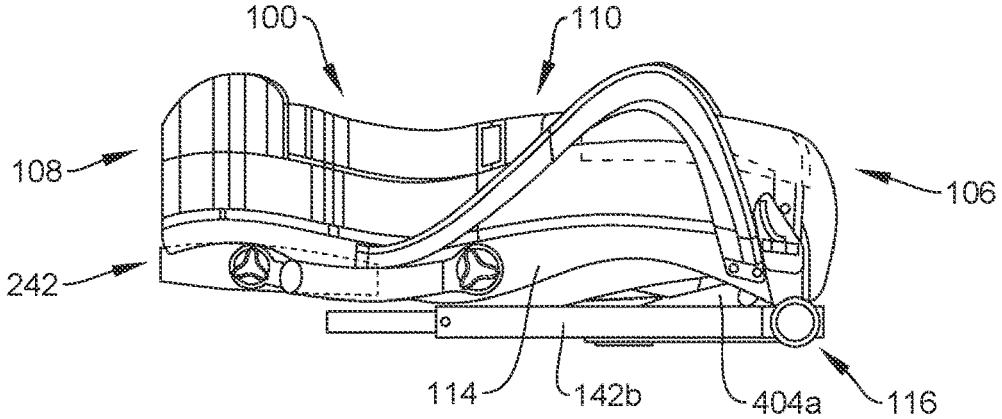
FIG. 34, in a side view, illustrates the chair of FIG. 33 in a folded position.
Figure 35:
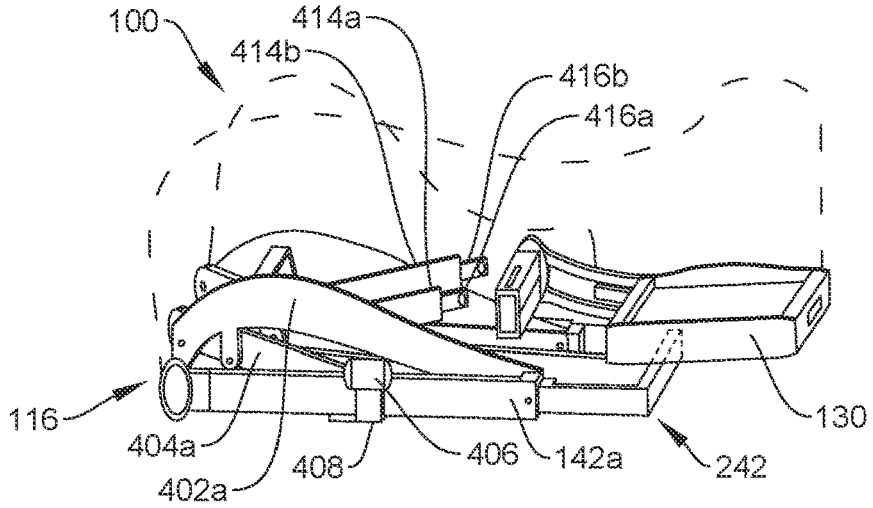
FIG. 35, in a side perspective view, illustrates the selectively adjustable deployment mechanism including slidable legs of the chair of FIG. 34.
Figure 36:
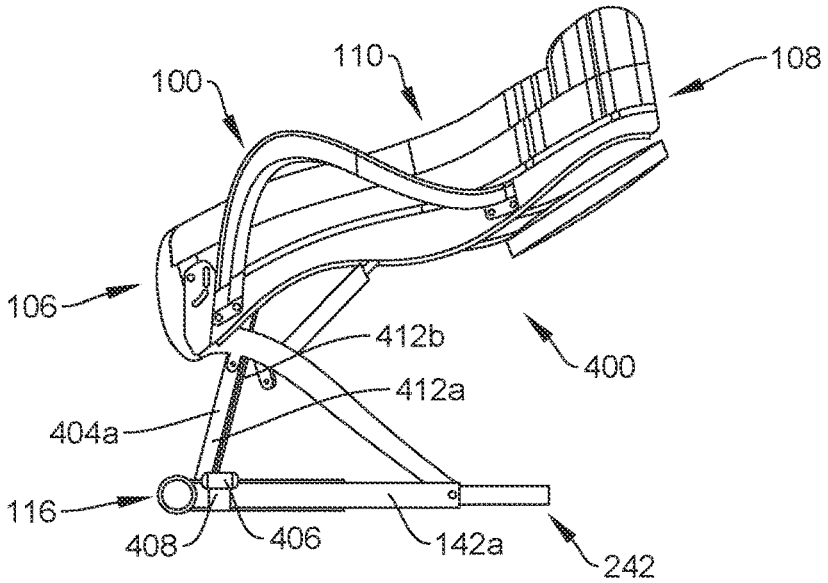
FIG. 36, in a side view, illustrates the chair of FIG. 32 in a lying position.

Slidably moving the pair of slide legs 404*a*, 404*b* along the pair of longitudinal rails 142*a*, 142*b*, from the forward end 116 towards the rearward end 242 the of the base 102 (as indicated by arrows in FIGS. 32 and 33), pivotally moves the pair of pivot legs 402*a*, 402*b* and the pair of slide legs 404*a*, 404*b* so as to move the body support 104 from a raised position towards a lowered position. Slidably moving the pair of slide legs 404*a*, 404*b* in an opposite direction along the pair of longitudinal rails 142*a*, 142*b*, from the rearward end 242 towards the forward end 116 of the base 102, pivotally moves the pair of pivot legs 402*a*, 402*b* and the pair of slide legs 404*a*, 404*b* so as to move the body support 104 from a lowered position towards a raised position. In the lowered position, the body support 104 is generally held proximal to the base 102 and may either be positioned angularly relative to the base 102, as illustrated in FIG. 33, or be positioned substantially parallelly relative to the base 102, as illustrated in FIGS. 34 and 35. In the raised position, the body support 104 is generally held above to the base 102 and may either be positioned angularly relative to the base 102, as illustrated in FIGS. 32 and 36, or be positioned substantially parallelly relative to the base 102.

To move the pair of slide legs 404*a*, 404*b* along the pair of longitudinal rails 142*a*, 142*b*, at least one motor drive unit 406 and at least one worm gear transmission 408 may be provided to the chair deployment mechanism 400 of the present embodiment. For example, a motor drive unit 406 may be provided on each longitudinal rails 142*a* and 142*b* and each operatively coupled to a corresponding worm gear transmission 408. A worm gear transmission 408 may be provided on each longitudinal rails 142*a* and 142*b* and corresponding slide legs 404*a* and 404*b*. Alternatively, a motor drive unit 406 may be provided on a single longitudinal rail 142*a* or 142*b*, and a worm gear transmission 408 may be provided on a single longitudinal rail 142*a* or 142*b* and a corresponding slide leg 402*a* or 402*b*. Also, the motor drive unit(s) 406 and worm gear transmission(s) 408 may be provided as an independent module to the chair deployment mechanism 400 of the present embodiment, for example for ease of manufacture and/or reparation.

Any other means known in the art that enables moving the pair of slide legs 404*a*, 404*b* along the pair of longitudinal rails 142*a*, 142*b* are also possible without departing from the scope of the invention. For example, the slide legs 404*a*, 404*b* may be slidably moved along the corresponding longitudinal rails 142*a*, 142*b* by at least one length adjustable elements (not illustrated in the figures), such as a pair of length selective telescopic cylinders including hydraulic and/or pneumatic cylinders, or even by slidably and pivotally moving the pivot legs 402*a*, 402*b* and the slide legs 404*a*, 404*b* manually and by providing a locking mechanism 146 as described herein with proper modification(s) already understood by the skilled person. For example, the locking mechanism 146, best shown in FIG. 41, may be integrated in the length adjustable element 414*a* or 414*b*, and be selectively activated or deactivated via an element located at a user reachable location on the chair.

Operation of the motor drive unit(s) 406 and worm gear transmission(s) 408 is performed by the user through the user control interface so as the user may selectively adjust the most convenient height above the ground or distance of the body support 104 relative to the base 102.

Figure 41:
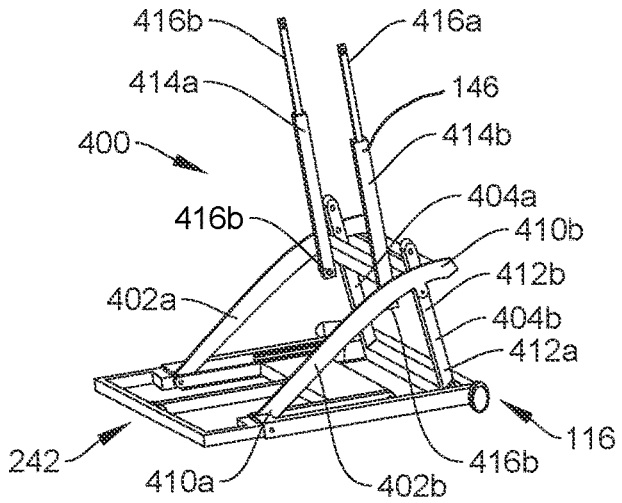
FIGS. 41 and 42, in side perspective views, illustrate the selectively adjustable deployment mechanism of the chair of FIG. 32 with or without slidable legs.
Figure 42:
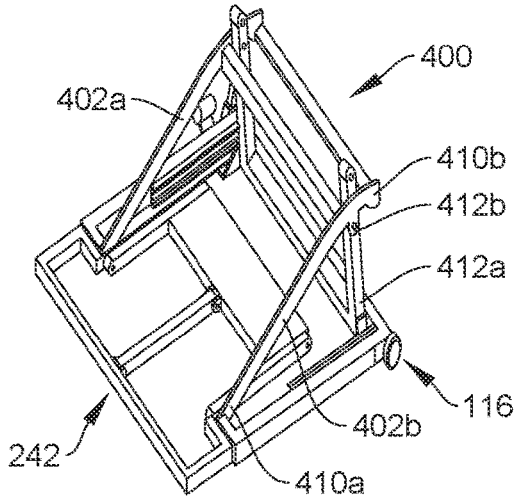
Figure 43:
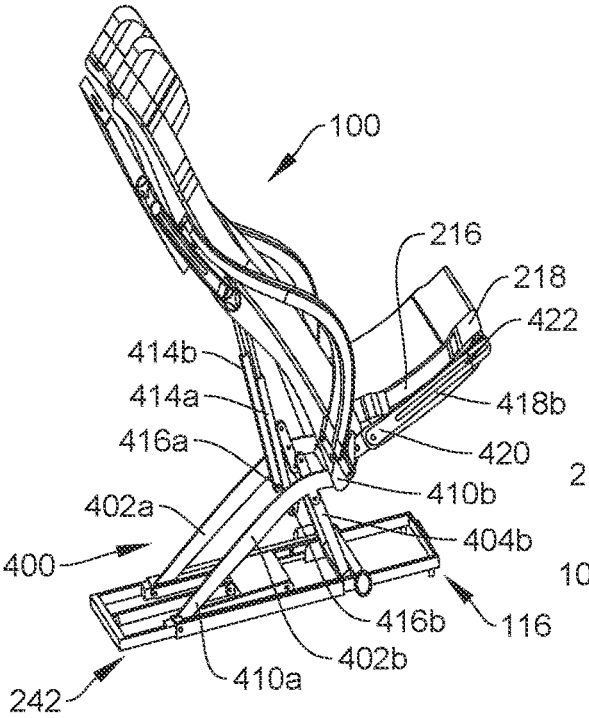
FIG. 43, in a side perspective view, illustrates the chair of FIG. 32 including a second mat segment in a retracted position.
Figure 44:
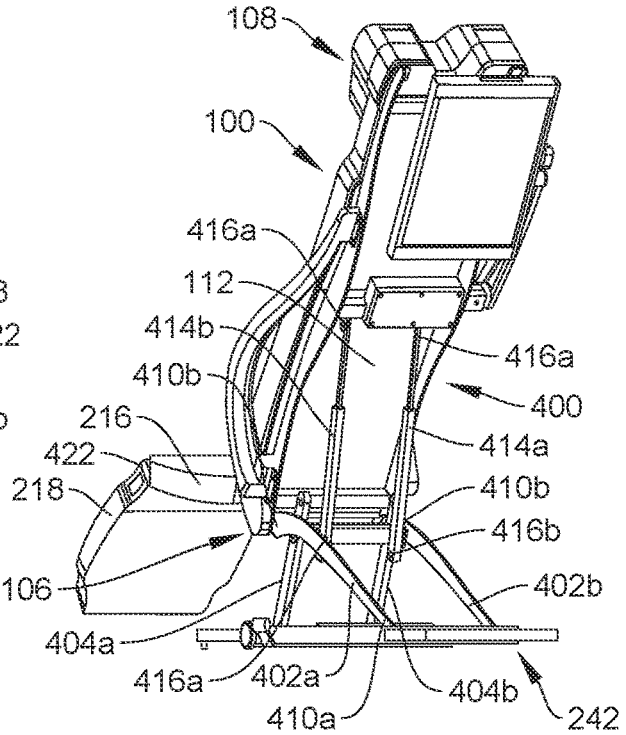
FIGS. 44 and 45, in rear-end perspective views, illustrates the chair of FIG. 43 including a second mat segment in an extended and inclined position.

The chair deployment mechanism 400 of the present embodiment further includes, as illustrated in FIGS. 41 to 44, a pair of length adjustable elements 414*a*, 414*b*, such as a pair of length selective telescopic cylinders including hydraulic and/or pneumatic cylinders. Particularly, FIGS. 41 and 42 illustrate the selectively adjustable chair deployment mechanism 400 in presence and absence of the length adjustable elements 414*a*, 414*b*, respectively. For their parts, FIGS. 43 and 44 illustrate the selectively adjustable chair deployment mechanism 400 with the length adjustable elements 414*a*, 414*b* connecting the body support rear surface 112 of the body support 104.

The pair of length adjustable elements 414*a*, 414*b* each have a first end portion 416*a* pivotally mounted at an intermediate longitudinal location between the first end portion 410*a* and the second end portion 410*b* on a corresponding pivot leg 402*a*, 402*b*. The pair of length adjustable elements 414*a*, 414*b* each also have a second end portion 416*b* pivotally supporting the body support 104 at an intermediate longitudinal location along the body support rear surface 112, between the body support proximal end 106 and the body support distal end 108.

Telescopically extending the pair of length adjustable elements 414*a*, 414*b* from a shorter configuration towards a longer configuration urges the body support 104 generally away from the base 102 so as the body support 104 pivots about the second end portion 410*b* of each of the pair of pivot legs 402*a*, 402*b* towards the forward end 116 of the base 102. Telescopically extending the pair of length adjustable elements 414*a*, 414*b* in an opposite direction, from a longer configuration towards a shorter configuration, urges the body support 104 generally closer to the base 102 so as the body support 104 pivots about the second end portion 410*b* of each of the pair of pivot legs 402*a*, 402*b* towards the rearward end 242 of the base 102.

Figure 50A:
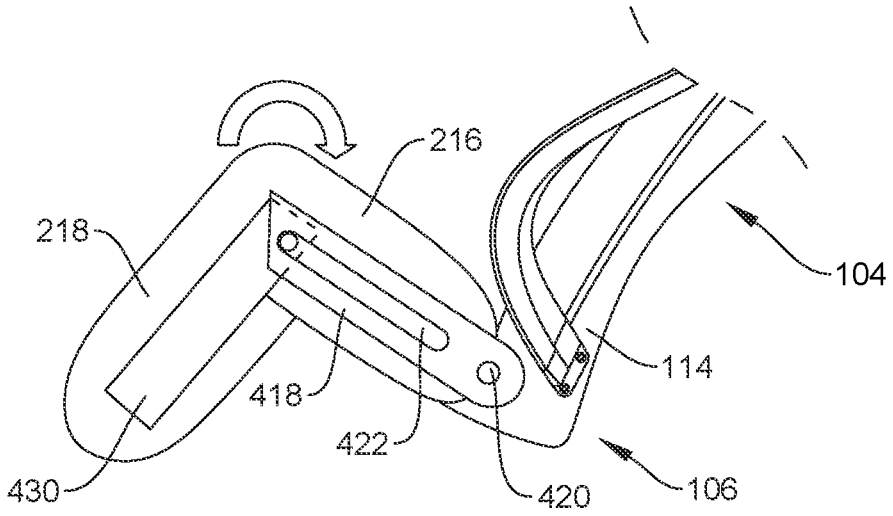
FIG. 50A, in a side view, illustrates a foldable multifunction chair, according to the present invention, here having an embodiment of elongated members for pivotally and/or telescopically mounting cushioned mat segments to the body support.
Figure 50B:
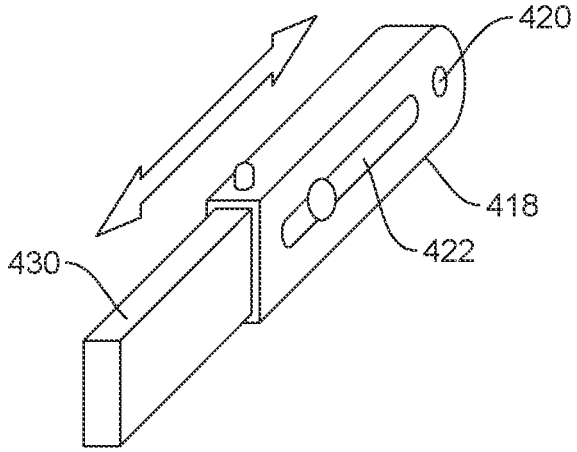
FIGS. 50B and 50C, in front-end perspective view and side view, respectively, illustrate the elongated members shown in FIG. 50A in an deployed and retracted positions, respectively.
Figure 50C:
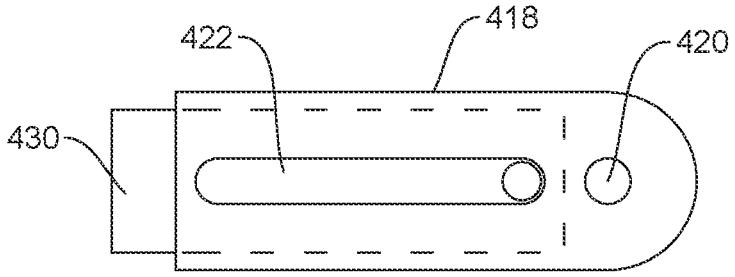

In some embodiments of the invention, and illustrated in FIGS. 50A-C, the chair includes a seat having a first seat mat segment 216 and a second seat mat segment 218. The first seat mt segment 16 is selectively pivotally mounted proximal to the body support proximal end 106 of the body support 104 by a pair of elongated members 418. Each of the elongated member 418 is coupled to a corresponding opposed side of the first seat mat segment 216, and is projecting from a corresponding side of the opposed body support longitudinal sides 114 of the body support 104. Each of the elongated members 418 includes a pivot hole 420, a projecting member 430 telescopically received thereinto, and a longitudinal slot 422 extending longitudinally therelaong. For selective pivotal movement of the first seat mat segment 216 relative to the body support 104, each pivot hole of corresponding elongated members 418 is pivotally mounted by a pin, such as a bolt pin and the like, proximal to the body support proximal end 106 and corresponding side of the opposed body support longitudinal sides 114 of the body support 104.

Figure 49:
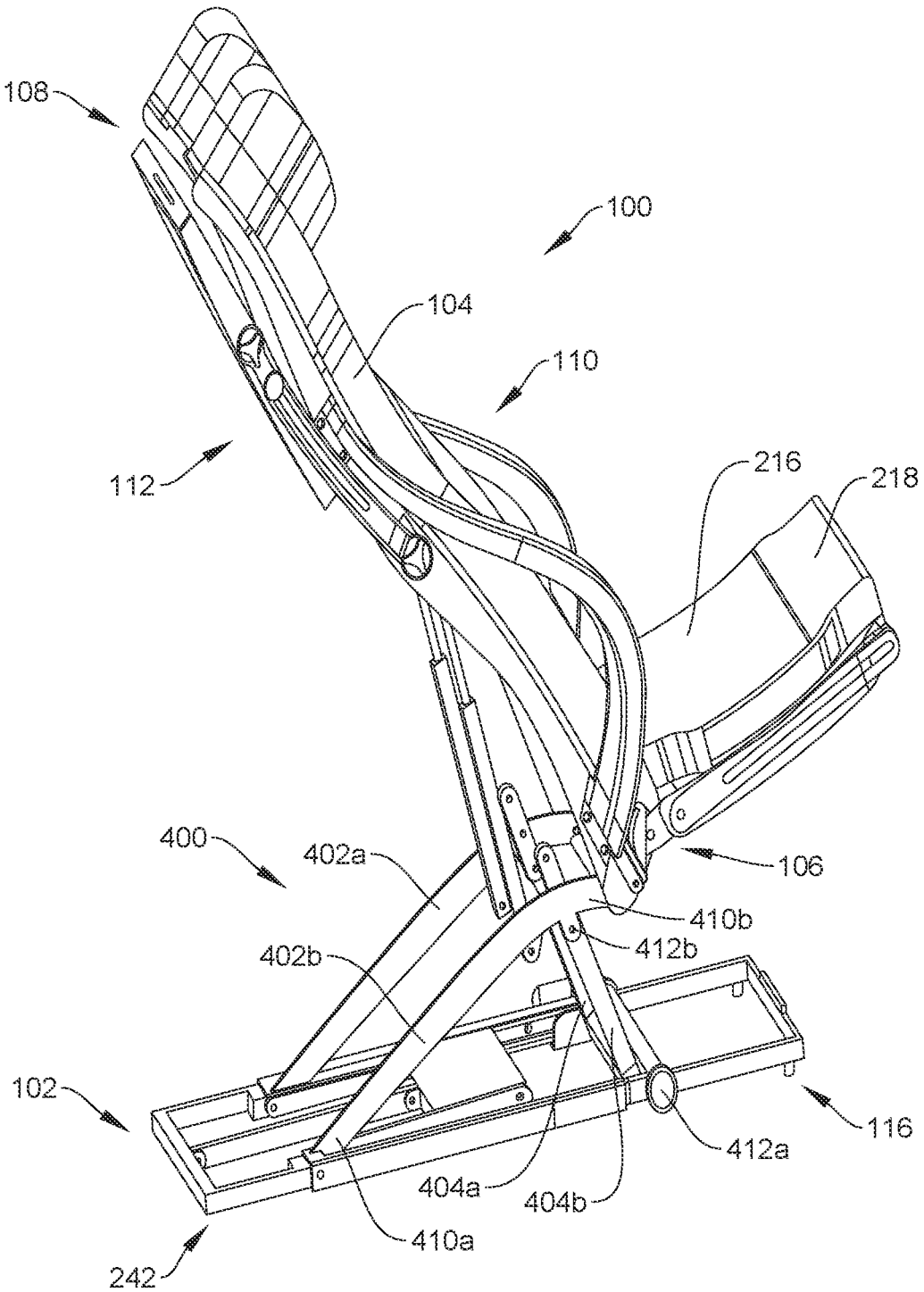
FIG. 49, in a side perspective view, illustrates a foldable multifunction chair, according to the present invention, here having an embodiment of a plurality of mouting apertures to selectively adjust the distance between the body support and the base.

In some embodiments of the invention, as still illustrated in FIGS. 50A-C, the second seat mat segment 218 is selectively telescopically mounted to the first seat mat segment 216 by the projecting members, which are each coupled to a corresponding opposed side of the second seat mat segment 218. As such, the projecting members may position the second seat mat segment 218 in a retracted position (as illustrated for example in FIGS. 43 and 49 for the chair 100, and in FIG. 50C for an elongated member 418), wherein the second seat mat segment 218 is retracted and contained within the first seat mat segment 216, and a deployed position, wherein the second seat mat segment 218 selectively telescopically projects away from the first seat mat segment 216 (as illustrated for example in FIGS. 37 to 40, 44, 45, and 50A for the chair 100, and in FIG. 50B for an elongated member 418).

Any other intermediate position between the retracted and deployed positions are also possible wherein the second seat mat segment 218 is partially retracted and contained within the first seat mat segment 216 or partially telescopically projected away from the first seat mat segment 216. In either position, the longitudinal slot 422 selectively removably locks the second seat mat segment 218 relative to the first seat mat segment 216 via frictional engagement of a slidable pin, such as a bolt pin and the like, that is connected to a corresponding projecting member 430 of a elongated members 418 and projects through a corresponding longitudinal slot 422 of the elongated members 418. Other mechanisms for selectively locking the second seat mat segment 218 relative to the first seat mat segment 216 are also possible without departing from the scope of the present invention.

In either a fully or a partially deployed position, the second seat mat segment 218 is further selectively pivotaly adjustable relative to the first seat mat segment 216 (as illustrated for example in FIGS. 38, 40, 44, 45, and 50A for the chair 100). For example, the second seat mat segment 218 may be angularly positionable relative to the first seat mat segment 216 by the frictional engagement of the slidable pin and/or by a pivot joint, such as the pivot joint 186 or any other pivot joint known in the art.

Therefore, in some embodiments of the invention, the second seat mat segment 218 is independently configurable in terms of length and angular position thereof relative to the first seat mat segment 216. For example, the second seat mat segment 218 may be disposed contiguously with the second seat mat segment 218, as illustrated in FIG. 43, In this last case, the first seat mat segment 216 and the second seat mat segment 218 may be secured together by any securing means known in the art, such as a zipper mechanism. The second seat mat segment 218 may also be disposed apart and angularly relative to the substantially rigid core of the first seat mat segment 216, as illustrated in FIG. 44.

Other known equivalent configurations and mechanisms for pivotally mounting the first seat mat segment 216 to the body support 104 and for pivotably and/or telescopically mounting the second seat mat segment 218 to the first seat mat segment 216 are also possible.

Figure 37:
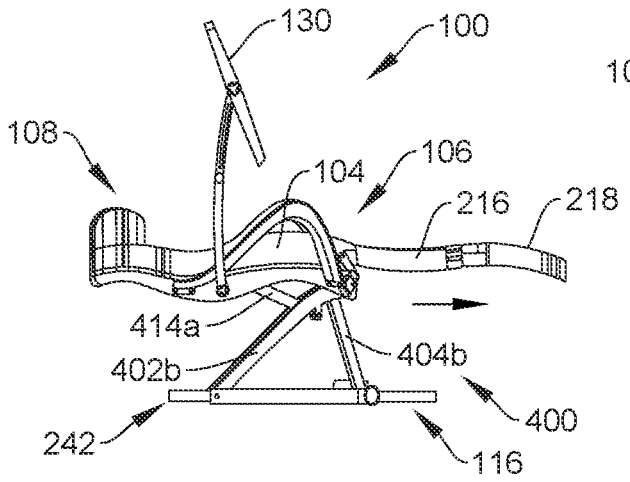
FIGS. 37 to 40, in various side views, illustrate the chair in FIG. 32 or 33 each in various possible states of deployment, position and usage, here shown including a length-adjustable support arm assembly with accessory.

In some embodiment of the present invention, the selectively adjustable chair deployment mechanism 400 enables the chair 100 to adopt various configurations. For example, the chair 100 may be in a raised position and have the body support 104, the first seat mat segment 216, and the second seat mat segment 218 parallel to the base 102, as illustrated in FIG. 37.

Figure 38:
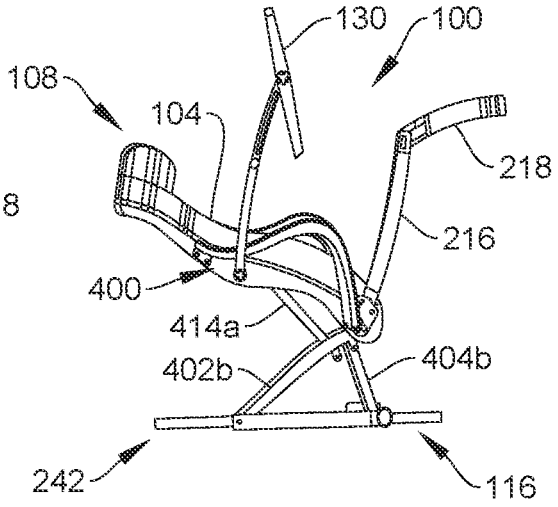
Figure 39:
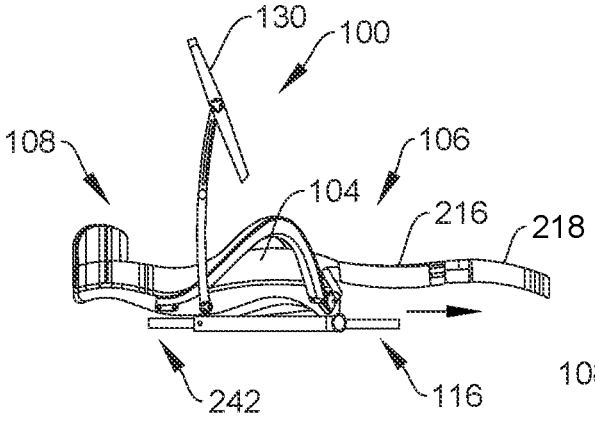
Figure 40:
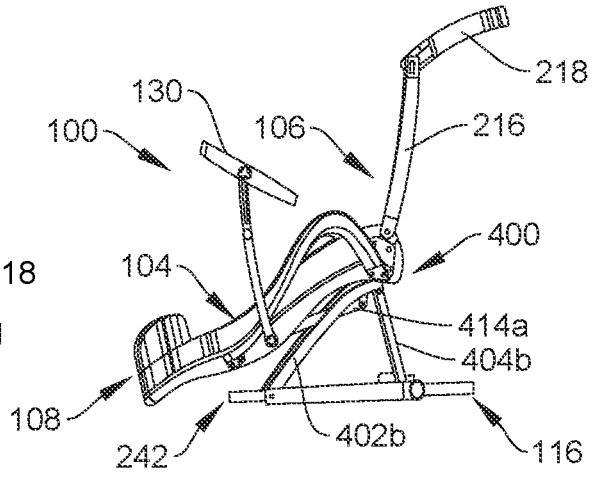

The chair 100 may be in a so-called "zero-gravity position", and be in a raised position and have the body support distal end 108 generally above the body support proximal end 106 of the body support 104 generally, while the first seat mat segment 216 is generally perpendicularly to the body support 104 and the second seat mat segment 218 is generally parallelly to the base, as illustrated in FIG. 38.

The chair 100 may be in a so-called "Tredelenburg position", and be in a raised position and have the body support distal end 108 generally below the body support proximal end 106 of the body support 104 generally, while the first seat mat segment 216 is generally perpendicularly to the body support 104 and the second seat mat segment 218 is generally parallelly to the base, as illustrated in FIG. 38.

The chair 100 may also be in a lowered position and have the body support 104, the first seat mat segment 216, and the second seat mat segment 218 generally parallelly to the base 102.

Figure 47:
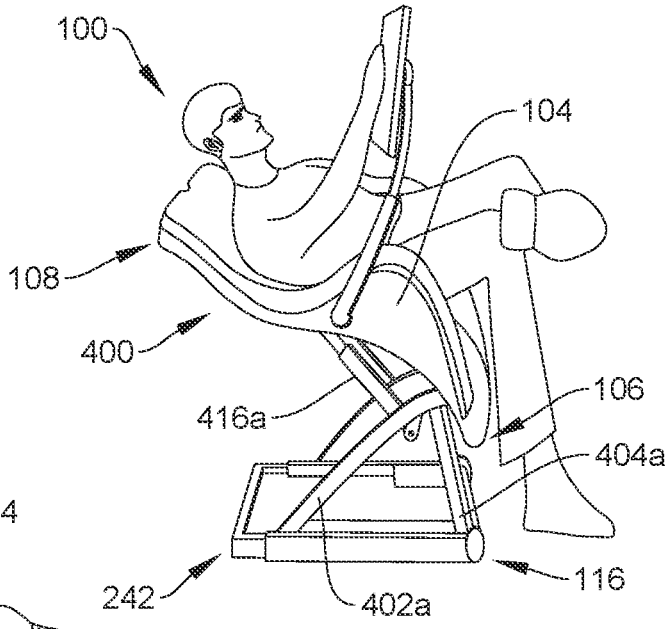
FIGS. 47 and 48, in side perspective views, illustrate the chair of FIG. 32 in various possible states of deployment, position and usage.
Figure 48:
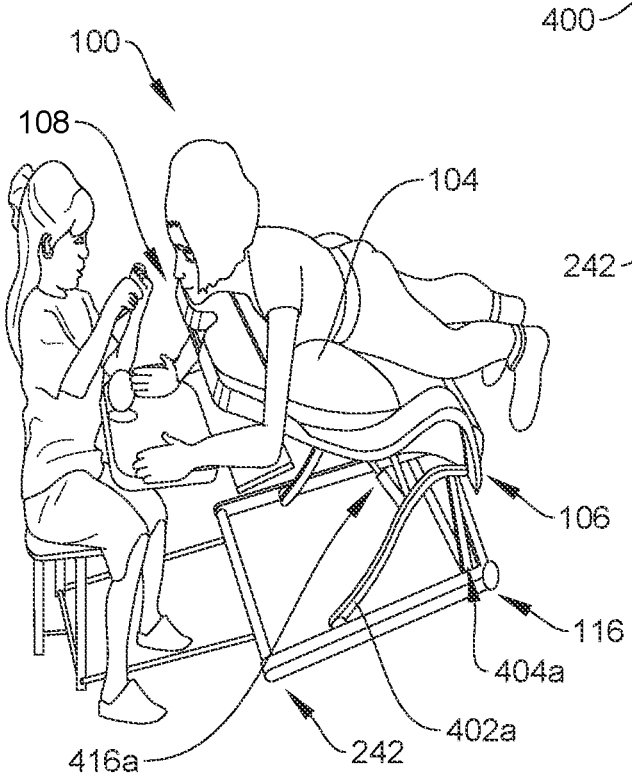

The chair 100 may also be in a raised position for a user to sit or lie on the body support 104 for performing various task, as illustrated in FIGS. 47 and 48.

Other known configurations and position of the chair 100 are possible with the selectively adjustable chair deployment mechanism 400.

Figure 46:
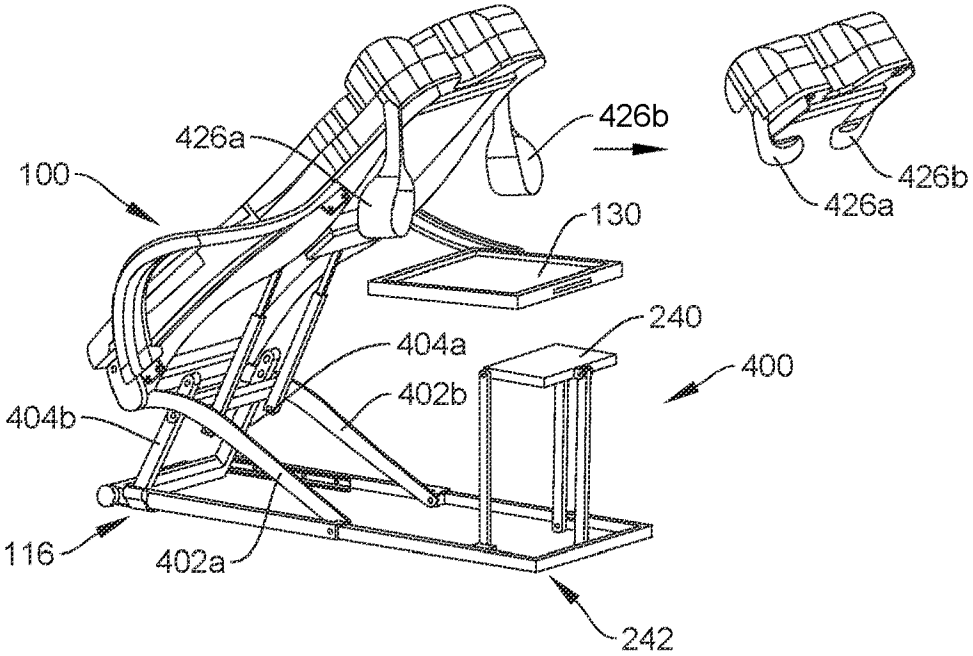
FIG. 46, in rear-end perspective views, illustrates the chair of FIG. 32 including elbows support in a deployed or folded position, and a collapsible seat in a deployed position.
Figure 45:
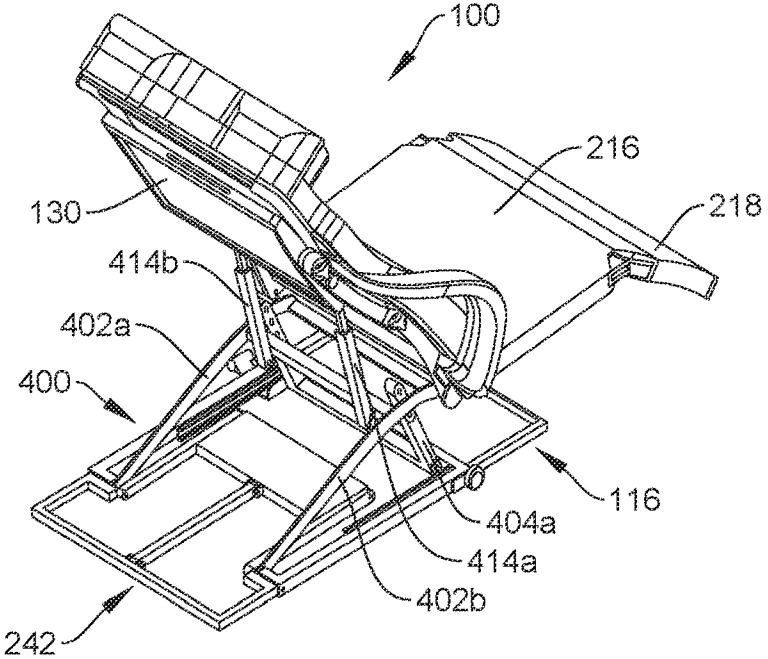

In some embodiments, such as illustrated in FIGS. 45 and 46, the chair 100 includes a pair of retractable elbow supports 426*a*, 426*b* mounted on the body support rear surface 112 and proximal the body support distal end 108 of the body support 104. The elbow supports 426*a*, 426*b* are foldable between a folded position and a deployed position. In the folded position, the elbow supports 426*a*, 426*b* are disposed generally parallelly to the body support 104 and may be concealed by the user accessory support 130 when the user accessory support 130 is located adjacently the body support rear surface 112 of the body support 104, as illustrated in FIG. 45. In the deployed position, the elbow supports 426*a*, 426*b* are each located on corresponding opposed body support longitudinal sides 114 and proximal the body support distal end 108 of the body support 104. In use, the elbow supports 426*a*, 426*b* serve to provide support to elbows of the user when, for example, the user is lying on the body support 104, e.g. as illustrated in FIG. 48.

Figure 15:
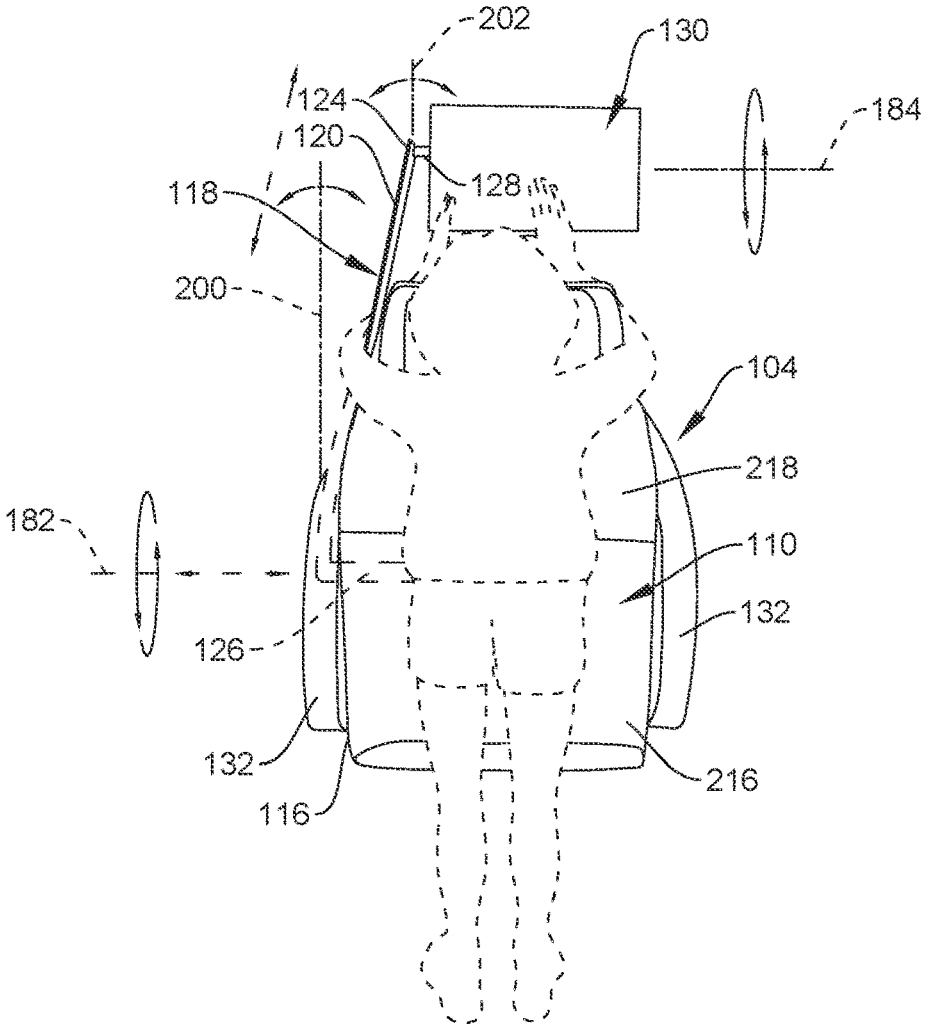

Referring, for example, to FIGS. 10 and 15, in some embodiments of the invention, the first and second selectively adjustable pivot joints 126 and 128 are selectively rotatably adjustable about a transversal axis 182 and 184 respectively, relative to the chair 100.

Figure 29:
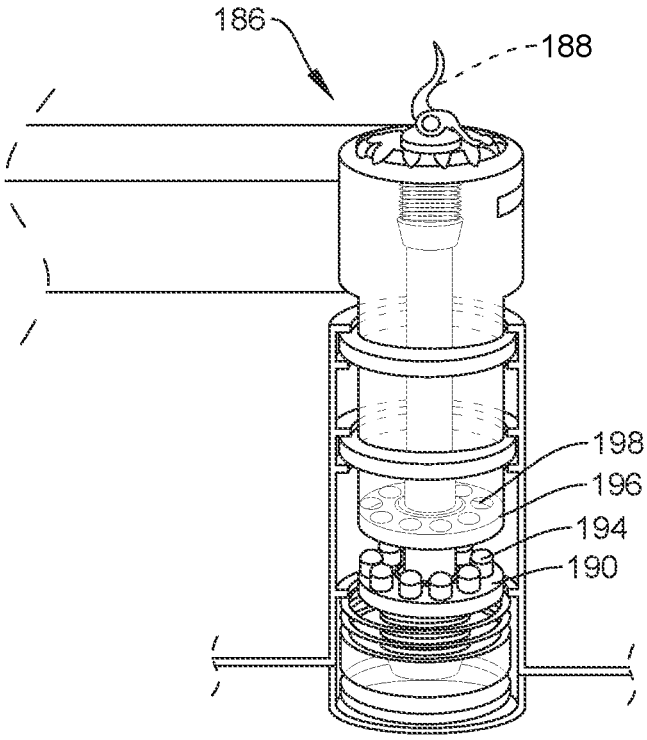
FIG. 29, in an enlarged, cut away view, illustrates an embodiment of a selectively adjustable pivot joint.

Referring to FIG. 29, an embodiment of a selectively adjustable pivot joint 186 rotatable about an axis includes a lever 188 that allows to user selectively engage a spring biased first wheel 190 having a laterally extending ring of teeth 194 with a second wheel 196 having a compatibly disposed ring of laterally extending bores 198. Other equivalent pivot joints rotatable about an axis that are well known in the art are also possible.

Figure 2:
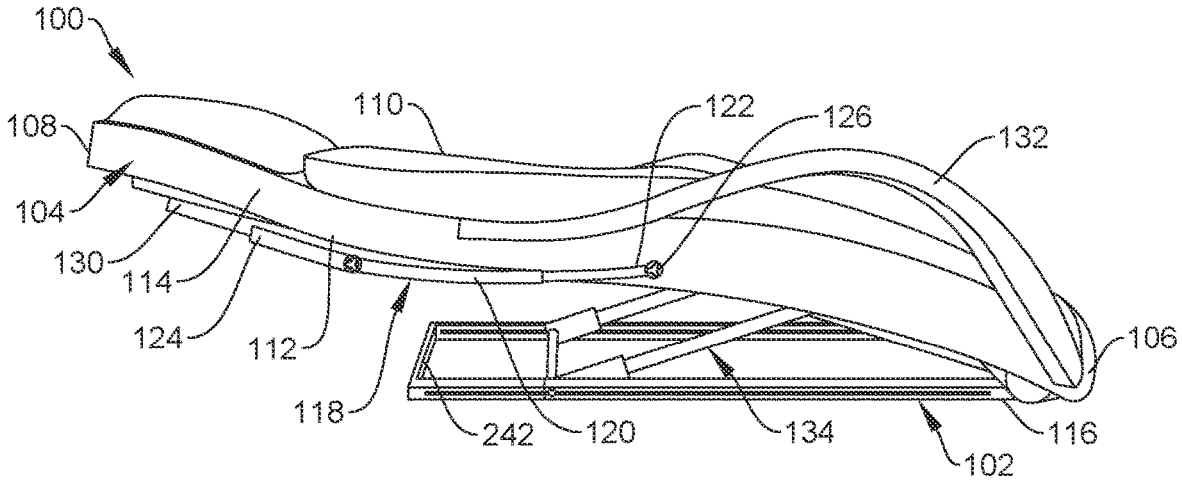
FIG. 2, in a side view, illustrates the chair in FIG. 1 in a slightly deployed position.
Figure 3:
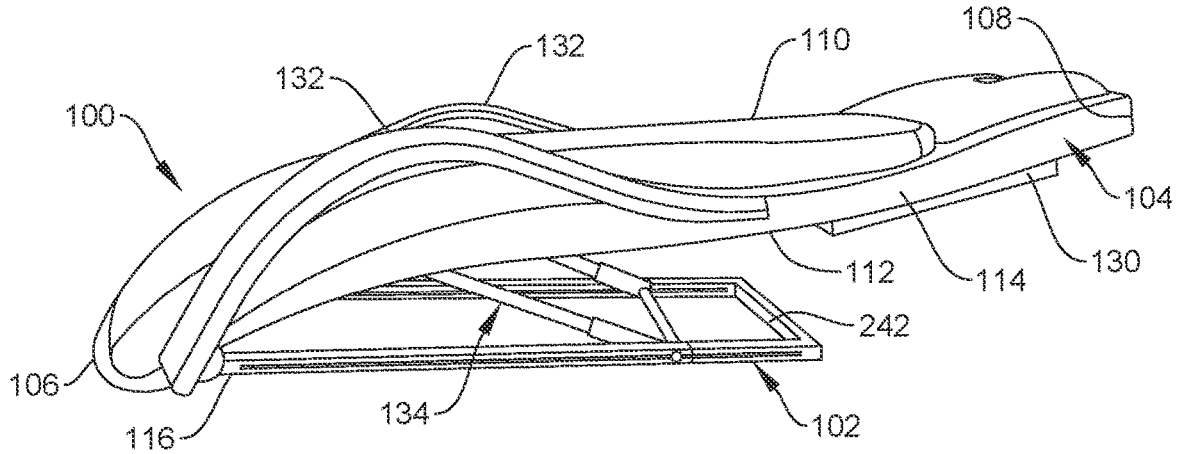
FIG. 3 illustrates the chair in a side view opposite the one shown in FIG. 2.

Furthermore, as best illustrated in FIG. 15, in some embodiments of the invention, at least the first selectively adjustable pivot joint 126 is further telescopically adjustable laterally relative along the longitudinal axis 182 relative to the chair 100. This lateral telescopic adjustment allows to retract laterally inwardly the arm assembly 118 relative to the chair 100 so as to attain relatively more compact format of the overall dimensions of the chair 100, as illustrated in FIGS. 2 and 5.

Furthermore, in some embodiments of the invention, at least the first, but preferably both the first and second selectively adjustable pivot joints 126 and 128 are further angularly laterally pivotable relative to imaginary longitudinal axis 200 and 202 of the chair 100.

Figure 28:
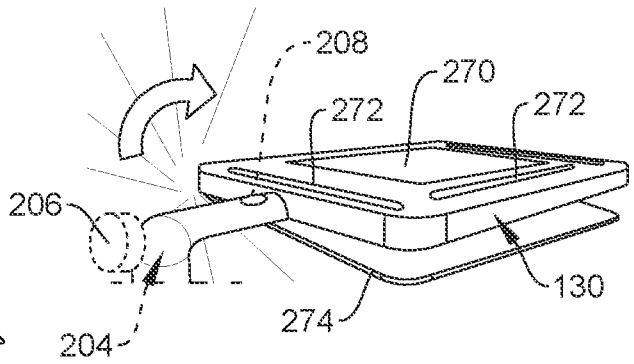
FIG. 28, in an enlarged, perspective view, illustrates an embodiment of an accessory coupled at a distal end of the support arm assembly.

As exemplified in FIG. 28, the first and second selectively adjustable pivot joints 126 and 128 may include a selectively adjustable universal ball type joint 204 to achieve universal movement and user selected angle setting of the joint. This type of selectively adjustable universal ball joint 204 provided with a setting handle 206 is well known in the art such as photography stands, camping equipment and the likes.

Still referring to FIG. 28, preferably, at least the second selectively adjustable pivot joint 128 has a selectively detachable coupling 208 interfacing with a compatible coupling provided along a suitable portion of the accessory support 130. Thus, with the accessory support 130 holding, for example, an electronic tablet device or the like may be detached from the chair 100 and conveniently brought elsewhere around the house.

Figure 4:
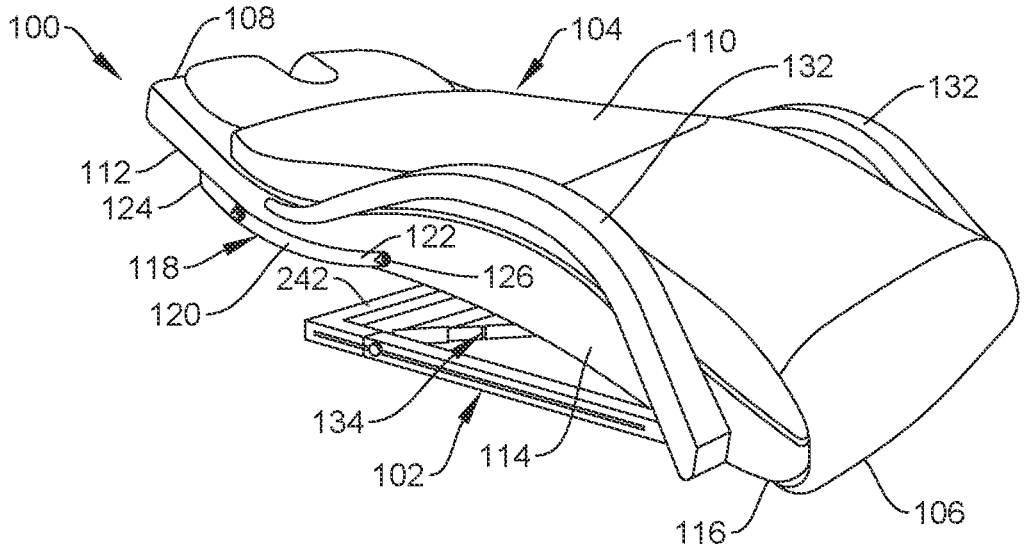
FIG. 4, in a front-end perspective view, illustrates the chair in FIG. 2.
Figure 7:
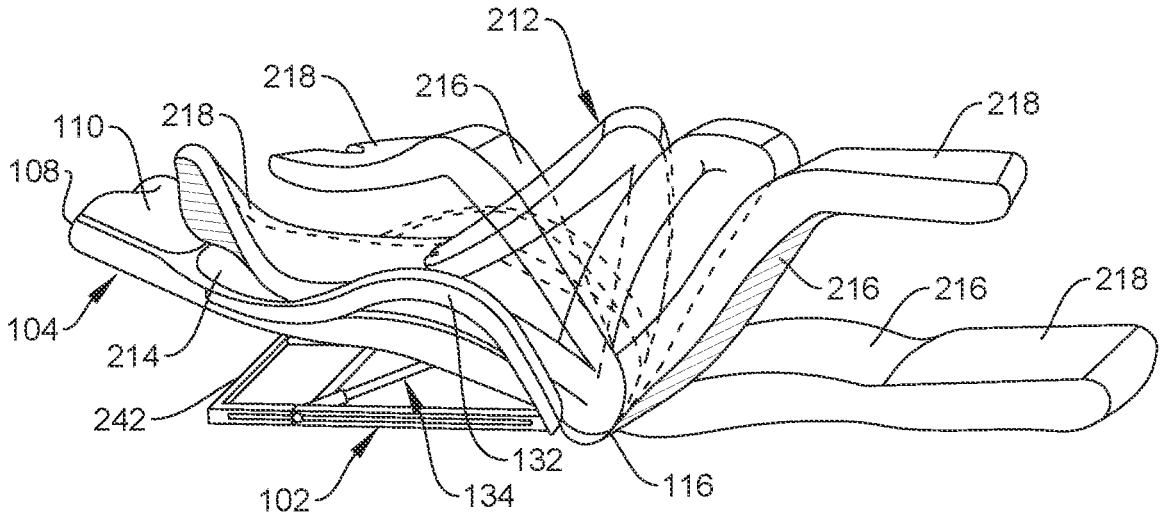
FIG. 7, in a side view, illustrates the chair in FIG. 2, here shown having a foldable padded mat in sequence views between a retracted and a deployed position.
Figure 8:
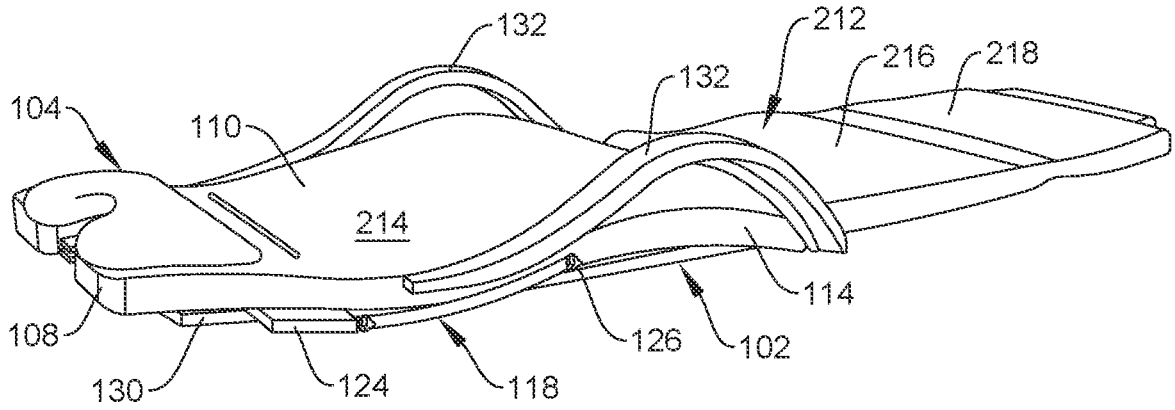
FIG. 8, in a rear-end perspective view, illustrates the chair in FIG. 7, here shown having a body support in a folded position, and the foldable padded mat in a fully deployed position.
Figure 16:
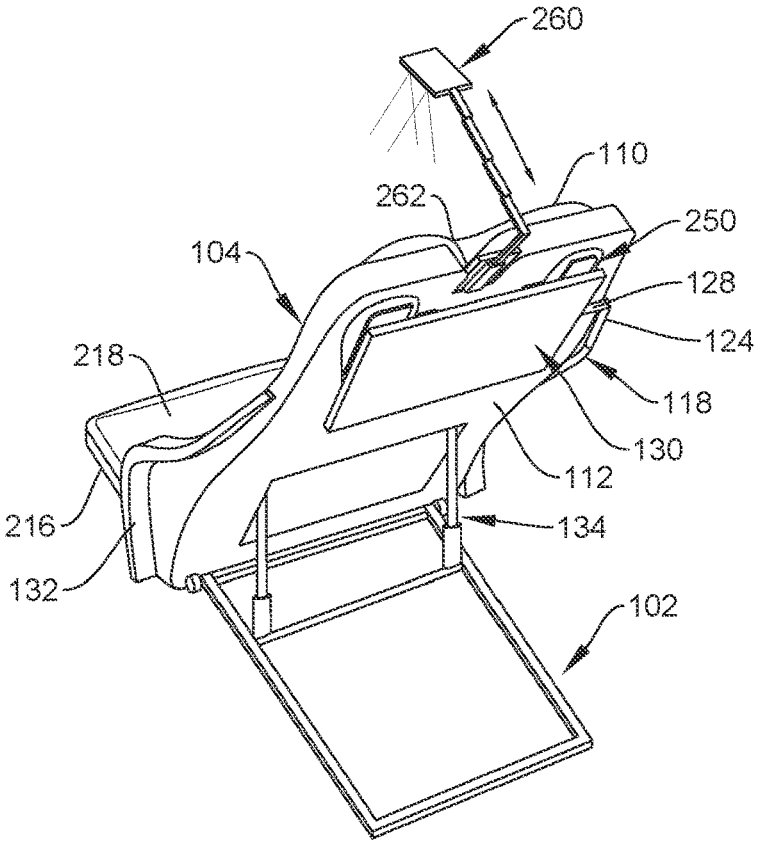

Preferably, as best illustrated in FIGS. 4, 7 and 8, the body support 104 includes a substantially rigid rear portion along the body support rear surface 112, and a cushioned front portion for comfort of the user along the body support front surface 110. Thus, when in an almost fully deployed position, the chair 100 may be used as a legless backrest type foldable chair resting directly on a support surface such as a floor, as illustrated in FIGS. 11 and 16. Alternatively, when in an intermediate deployed position, as illustrated in FIGS. 2, 9, 14 and 15, the chair 100 may allow a user to rest on his or her front to read a book or the like.

Furthermore, the body support 104 further includes a foldable double-sided cushioned mat extension 212, as illustrated for example on FIGS. 7 and 8, having a longitudinal proximal end pivotably attached transversally along the body support proximal end 106. When in a retracted position, the mat extension 212 is configured and sized to uniformly nest in a shallow depression 214 defined along a longitudinal portion of the front surface of the cushioned front portion of the body support 104.

And when in a deployed position, the mat extension 212 may be used as a cushioned seat element, as illustrated in FIG. 11, or alternatively, in cooperation with the cushioned front portion of the body support 104, as a full-length sleeping mattress, as illustrated in FIG. 8.

Further preferably, as illustrated in FIGS. 7 and 11, the mat extension 212 is foldable about at the middle in a first and second mat segment 216 and 218 for use a double cushioned seat element.

In some embodiments, any one of the chair 100, the first seat mat segment 216, the second seat mat segment 218, and the double-sided cushioned mat extension 212 may include a mat securing means, such as a zipper, a velcro, a snap-fit button and the like, that is configured to secure together at least two of the chair 100, first seat mat segment 216, the second seat mat segment 218, and the double-sided cushioned mat extension 212. The mat securing means allows any one of the first seat mat segment 216, the second seat mat segment 218, and the double-sided cushioned mat extension 212 to be secured together and/or to the chair 100. In such a secured arrangement, the first seat mat segment 216, the second seat mat segment 218, and the double-sided cushioned mat extension 212 cannot be easily removed from the chair 100, which is convenient, e.g., when transporting the chair as the first seat mat segment 216, the second seat mat segment 218, and the double-sided cushioned mat extension 212 may not fall from the chair 100 and generally have a compact configuration.

Figure 20:
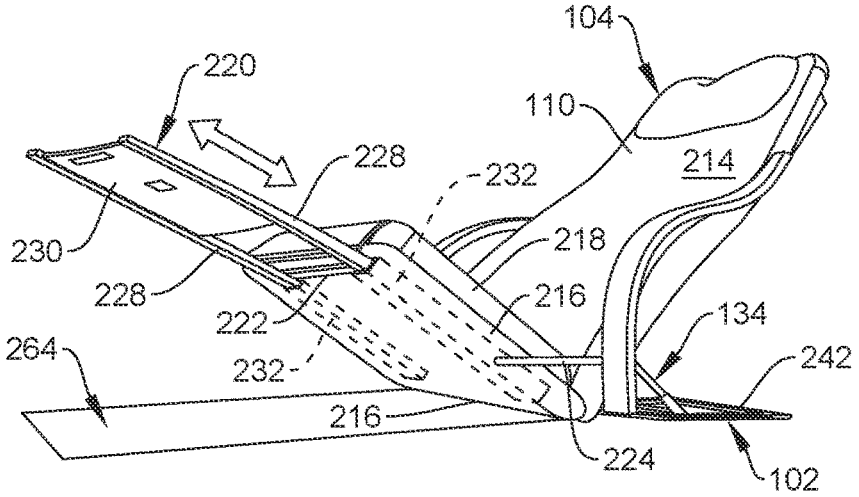
FIGS. 20 and 21, in front-end perspective views, illustrate the chair in FIG. 2 having a retractable mat support and a protective carpet extension, each in a deployed position.
Figure 21:
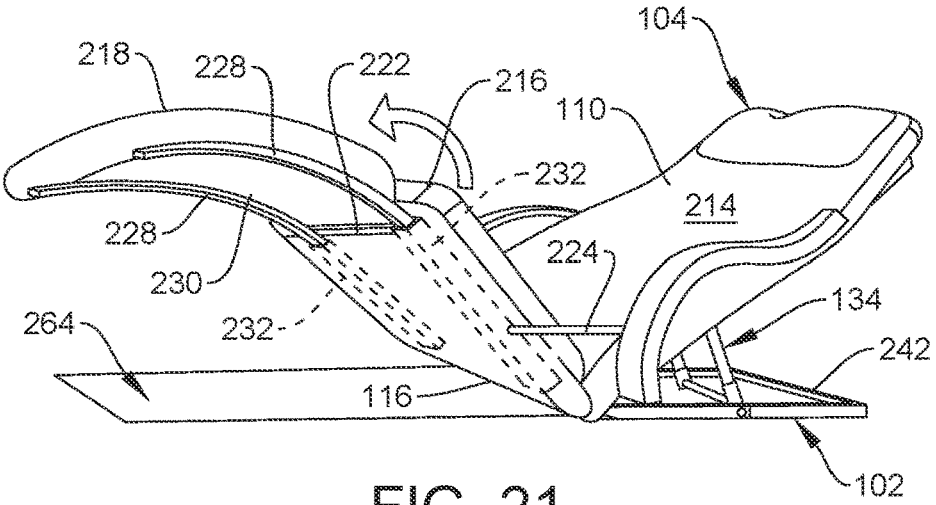

Referring to FIGS. 20 and 21, further preferably, first seat mat segment 216 closest to the body support 104 includes a substantially rigid core, and a retractable mat support 220 longitudinally retractable in a longitudinal slot 222 defined along the forward transversal end thereof.

The retractable mat support 220 is longitudinally movable between a mat support retracted position wherein it is concealed through longitudinal slot 222 and within the first seat mat segment 216, and a mat support extended position wherein it is longitudinally extended forwardly outside the first seat mat segment 216.

Furthermore, the first seat mat segment 216, in cooperation with a pair of removably attachable links 224 on each sides with the body support 104, and the retractable mat support 220 in the mat support extended position, may serve to support the second seat mat segment 218, so as to maintain a substantially S-shaped long chair configuration, as illustrated in FIG. 21.

As exemplified in the figures, the retractable mat support 220 may include semi-rigid and parallelly longitudinally extending pair of resilient stem members 228 joined by a flexible sheet 230 of material. The stem members 228 being freely telescopically engaged in tubular members 232 embedded in the first seat mat segment 216.

Other known equivalent configurations and materials for the retractable mat support 220 are also possible.

Alternatively to the retractable mat support 220, the second seat mat segment 218 may also include a substantially rigid core which, in cooperation with an additional pair of removably attachable links 224 on each sides with the first seat mat segment 216, may as well serve to maintain the S-shaped long chair configuration, as illustrated in FIG. 10.

In some embodiments of the invention, as illustrated in FIGS. 18 and 19, the chair 100 may further include a collapsible seat 240. The collapsible seat 240 is pivotably connected to a rearward end 242 of the base 102 and is user selectively movable between a collapsed and substantially flat position that is substantially coplanar with a rearward top portion of the base 102, and a pivoted out and deployed position adjacent the rearward end 242 of the base 102.

The collapsible seat 240 is suitably sized and dimension, in cooperation with the configuration of the base 102, to allow the body support 104 to adopt its folded position, as illustrated in FIG. 1 when the collapsible seat 240 is in the collapsed position.

As exemplified in the figures, the collapsible seat 240 may be any known collapsible or foldable seat that can adopt a relatively flat configuration when in a collapsed position, combined with a pair of pivot arms 244, or equivalent, pivotably linking a leg portions of the collapsible seat 240 with the rearward end 242 of the base 102.

In some embodiments of the invention, as illustrated in FIGS. 9, 10, 14 and 15, the chair 100 may further include a pair of retractable forearm supports 250 each attached adjacent a respective longitudinal side of a distal end portion of the body support rear surface 112 preferably, as illustrated, or alternatively along a respective body support longitudinal side 114.

For example, each pair of retractable forearm supports 250 may include a retractable arm element 252 having one end attached to the chair 100 and the opposed end pivotably supporting an elongated padded support element 254.

The pair of retractable forearm supports 250 is selectively movable between a forearm support retracted position wherein the padded support element 254 is located in proximity with a surface portion of the chair 100, and a forearm support extended position wherein the padded support element 254 is spaced away from the surface portion of the chair 100.

Other types and configuration for the pair of retractable forearm supports 250 are also possible.

Figure 6:
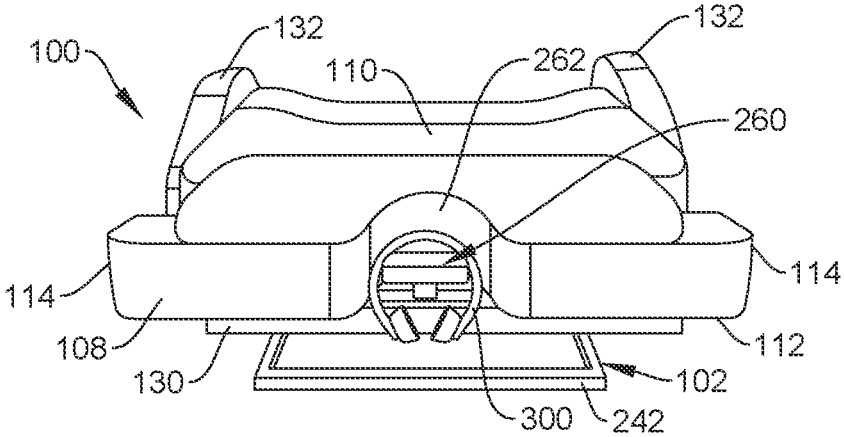
FIG. 6, in a rear-end view, illustrates the chair in FIG. 2.

In some embodiments of the invention, as illustrated, for example, in FIGS. 5, 6 and 16, the chair 100 may further include a retractable LED lamp 260, or equivalent, concealed in a recess 262 extending longitudinally inwardly relative to the body support distal end 108.

Preferably, the recess 262 is sufficiently wider than the retractable lamp 260 so as to stow away therein a user's headphone set 300 engaged in a saddle like fashion on a longitudinal base portion of the lamp 260, as exemplified in FIG. 6.

It is to be noted that the body support 104 and other components of the presently described invention, may further include embedded or attached to portion(s) thereof, one or more convenient to have power sources and other known electronic devices often found in multimedia chairs. As non-limitative examples, the chair 100 may include USB chargers, common electrical outlets (110-220 VAC), multimedia player devices (music and/or video players), and the likes.

In some embodiments of the invention, as illustrated in FIG. 22, the chair 100 may further include a protective, flexible carpet 264 having one end attached to an underside portion of the base 102, and at least partially longitudinally forwardly extend relative thereof, for protecting the support surface of the chair 100.

In some embodiments of the invention, as illustrated in FIG. 22, the chair 100 may further include a retractable base extension 266, for example, in the form of a U-shaped member 268 longitudinally slidably engaged through the forward end 116 of the base 102. The retractable base extension 266 is selectively movable between a base extension retracted and extended position relative to the base 102, so as to selectively provide a relatively greater longitudinal base support, such as when the body support 104 is raised at a substantially perpendicular angle relative to the base 102.

Other known configurations of equivalents for a retractable base extension are also possible.

In some embodiments of the invention, the accessory support 130 may include embedded known accessories and devices such an additional lamp 269, as illustrated in FIG. 13, an embedded electronic tablet 270 or a mirror with contour lamps 272, as illustrated in FIG. 28, a pivotable kick stand 274 usable when the accessory support 130 is detached from the chair 100, or that can serve as a transparent protective cover for an embedded tablet 270.

The accessory support 130 may further include a retractable keyboard support (not shown in the figures) for supporting a wireless keyboard or electronic pen pad.

In some embodiments of the invention, as illustrated in FIG. 27, the chair 100 may further include two or more luggage wheels 280 or equivalent rotatably mounted at one longitudinal end of the chair 100, so as to conveniently allow a rolled transport by manually grabbing the chair 100 by the opposite longitudinal end thereof. Thus, the chair 100 may be easily and conveniently moved around the house, the school, through airports during air travels, and the likes.

Figure 30:
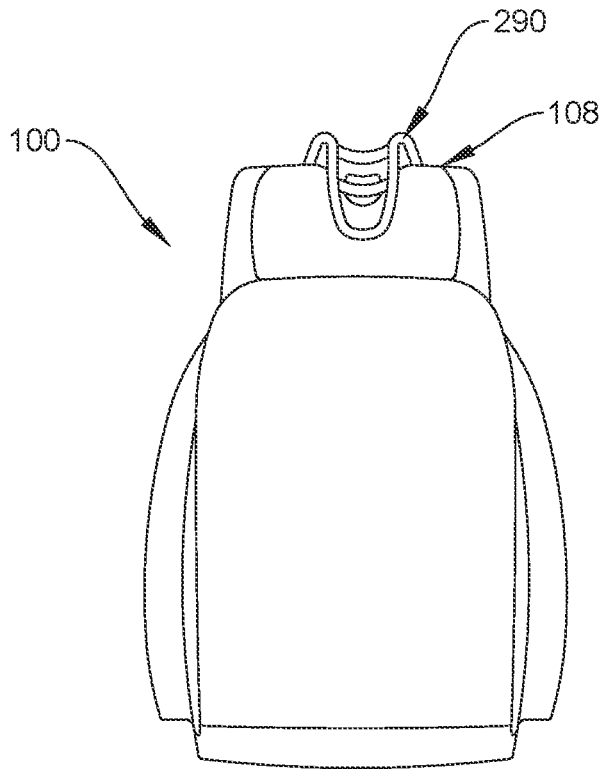
FIGS. 30 and 31, in a front-end perspective and side views, illustrate the chair in FIG. 2, here shown including a selectively removable and adjustable headrest.
Figure 31:
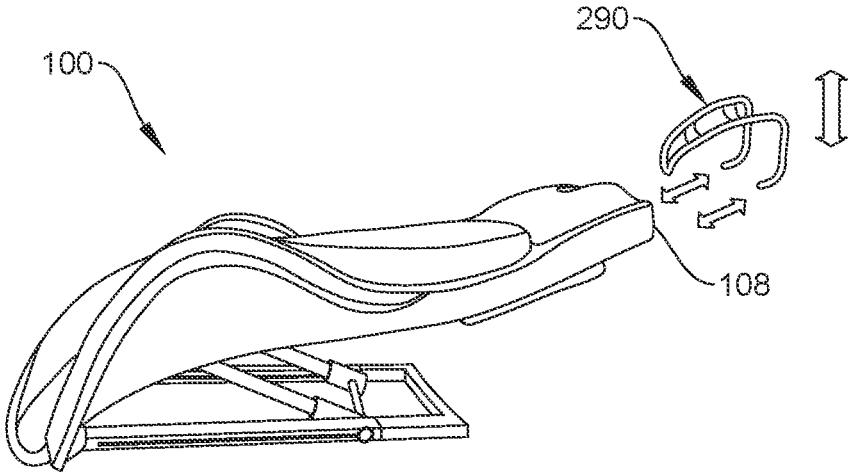

In some embodiments of the invention, as illustrated in FIG. 30-31, the chair 100 may further include a selectively removable and adjustable headset 290 connected substantially adjacent the body support distal end 108.

The components of the various embodiments of the foldable multifunction chair 100 described heretofore may be made of materials well known in the home and office furniture industry. Preferably, the materials used are substantially light weight, yet sufficiently rigid and robust as the chair 100 inherently represents a movable furniture typically designed to support an adult.

Thus, there has been described heretofore various embodiments of a new and inventive assembly for a foldable multifunction chair 100 that allows a user to adopt various comfortable postures for a restful rest, entertainment, or desk work. None of the known backrest type of comparable foldable chairs, such as legless foldable beach chairs and the like, can achieve so many possibilities in terms of comfortable user postures and functional utility of the chair.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A foldable multifunction chair, comprising:

a base for contacting a support surface, the base having at least one longitudinal rail extending between a base forward end and a base rearward;

a user body support having a support front surface for contacting a user body, the user body support being adjustably pivotably mounted to the base;

a selectively adjustable chair deployment mechanism cooperatively coupled to the base and the user body support, the chair deployment mechanism including:

a support structure comprising at least one pivot leg, at least one slide leg, a motor means, and a transmission means, the at least one pivot leg having a first pivot leg end pivotally mounted to the base and a second pivot leg end mounted to the body support, the at least one slide leg having a first slide leg end slidably and pivotally mounted to the at least one longitudinal rail and a second slide leg end pivotally mounted to the body support, the motor means being operatively coupled to the transmission means, the transmission means being operatively coupled to the first slide leg end, wherein activating the motor means longitudinally moves the first slide leg end along the at least one longitudinal rail and selectively adjusts the distance between the user body support and the base;

a length adjustable element having a first element end and a second element end, the first element end being pivotally mounted to the user body support, the second element end being pivotally mounted to the base, wherein varying the longitudinal length of the length adjustable element selectively adjusts the user body support to a desired angle relative to the base; and a locking mechanism configured for angularly locking the user body support to the desired angle relative to the base.

2. The foldable multifunction chair of claim 1, wherein the motor means comprises an electric motor and the transmission means comprises a worm gear transmission.

3. The foldable multifunction chair of claim 1, further comprising a plurality of mounting holes disposed on each of the second slide leg end of the at least one slide legs, each of the plurality of mounting holes being configured for selectively and removably mounting the second pivot leg end of a corresponding pivot leg so as the distance of the user support body relative to the base when the selectively adjustable chair deployment mechanism is in a deployed position is selectively adjustable.

4. The foldable multifunction chair of claim 1, further comprising a support mat for covering the support front surface of the user body support front, a first seat mat segment, a second seat mat segment, and a mat securing means, the first seat mat segment being selectively pitovally mounted to the user body support, the second seat mat segment being selectively telescopically and selectively pitovally mounted to the first seat mat segment, the securing means being configured for securing at least one of the support mat, the first seat mat segment, and the second sat mat segment with the other or to the chair.

5. The foldable multifunction chair of claim 1, further comprising an arm assembly coupled to a user accessory support, the arm assembly comprising a telescopically adjustable section and a selectively adjustable pivot joint for selectively positioning the user accessory support relative to the chair.

6. The foldable multifunction chair of claim 1, further comprising any one of an armrest, a retractable forearm support, a retractable retractable elbow, and a retractable neckrest and headrest.

* * * * *